US009895914B2

(12) United States Patent
Yamabe et al.

(10) Patent No.: US 9,895,914 B2
(45) Date of Patent: Feb. 20, 2018

(54) MEDIA TRANSPORTING DEVICE AND INKJET PRINTER

(71) Applicant: MIMAKI ENGINEERING CO., LTD., Nagano (JP)

(72) Inventors: Katsutoshi Yamabe, Nagano (JP); Yusaku Matoba, Nagano (JP); Eiji Miyashita, Nagano (JP); Akira Takeuchi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/311,506

(22) PCT Filed: May 15, 2015

(86) PCT No.: PCT/JP2015/064038

§ 371 (c)(1),
(2) Date: Nov. 15, 2016

(87) PCT Pub. No.: WO2015/174521

PCT Pub. Date: Nov. 19, 2015

(65) Prior Publication Data

US 2017/0087903 A1 Mar. 30, 2017

(30) Foreign Application Priority Data

May 16, 2014 (JP) ..... 2014-102905

(51) Int. Cl.
*B41J 15/16* (2006.01)
*B41J 2/01* (2006.01)
(Continued)

(52) U.S. Cl.
CPC ..... *B41J 15/16* (2013.01); *B41J 2/01* (2013.01); *B65H 23/182* (2013.01); *B65H 23/195* (2013.01)

(58) Field of Classification Search
CPC ..... B41J 15/16; B41J 15/165; B65H 23/1955; B65H 23/198; B65H 23/195;
(Continued)

(56) References Cited

U.S. PATENT DOCUMENTS

2013/0278666 A1* 10/2013 Hori ..... B41J 15/16 347/16

FOREIGN PATENT DOCUMENTS

JP S5433715 3/1979
JP 2007307786 11/2007
(Continued)

OTHER PUBLICATIONS

"International Search Report (Form PCT/ISA/210)", dated Aug. 4, 2015, with English translation thereof, pp. 1-4.

*Primary Examiner* — Henok Legesse
(74) *Attorney, Agent, or Firm* — JCIPRNET

(57) ABSTRACT

A tension applying member of an inkjet printer can apply tension on a printing medium by pushing a portion of the printing medium that is not wound by a winding mechanism by its own weight in a rotating direction indicated with an arrow having an axis line as a center; a transport controller causes a motor to generate a power for winding the printing medium when a predetermined tension is no longer applied on the printing medium by the tension applying member; and the winding mechanism limits a torque with a torque limiter and applies a predetermined tension on the printing medium when the motor is caused to generate the power for winding the printing medium when the predetermined tension is no longer applied on the printing medium by the tension applying member.

4 Claims, 17 Drawing Sheets

(51) Int. Cl.
*B65H 23/182* (2006.01)
*B65H 23/195* (2006.01)

(58) Field of Classification Search
CPC ..... B65H 23/182; B65H 23/1825; B65H 23/185; B65H 23/1888; B65H 23/192
See application file for complete search history.

(56) References Cited

FOREIGN PATENT DOCUMENTS

| | | | | |
|---|---|---|---|---|
| JP | 2013022744 | | 2/2013 | |
| JP | 2014-069932 | * | 4/2014 | ..... B41J 15/16 |
| JP | 2014069932 | | 4/2014 | |

* cited by examiner

MEDIA TRANSPORTING DEVICE AND INKJET PRINTER

CROSS-REFERENCE TO RELATED APPLICATION

This application is a 371 application of the international PCT application serial no. PCT/JP2015/064038, filed on May 15, 2015, which claims the priority benefit of Japan application No. 2014-102905, filed on May 16, 2014. The entirety of each of the above-mentioned patent applications is hereby incorporated by reference herein and made a part of this specification.

TECHNICAL FIELD

The present invention relates to a media transporting device for transporting a band-shaped medium, and an inkjet printer.

BACKGROUND ART

A conventional media transporting device including a winding mechanism that winds a band-shaped medium into a roll, a tension applying member that can apply tension on the medium by pressing a portion of the medium that is not wound by the winding mechanism by its own weight in a rotating direction having a specific axis line as a center; and a transport controller that controls the transportation of the medium is known (see e.g., Patent Literature 1). The winding mechanism includes a motor that generates power for rotating the wound medium. The tension applying member can also apply tension on the medium when an angle having the specific axis line as the center is at least within a specific range. The transport controller causes the motor to stop the generation of the power for winding the medium with the winding mechanism when the angle of the tension applying member having the specific axis line as the center is within the specific range. The transport controller causes the motor to generate the power for winding the medium with the winding mechanism when the angle of the tension applying member having the specific axis line as the center is outside the specific range. In other words, the media transporting device can continue to apply tension on the medium with the tension applying member by controlling the motor so that the angle of the tension applying member having the specific axis line as the center falls within the specific range.

CITATION LIST

Patent Literature

Patent Literature 1: Unexamined Japanese Patent Publication No. 2013-22744

SUMMARY OF INVENTION

Technical Problems

When a diameter of the medium wound by the winding mechanism becomes large, a distance from a rotating shaft to an outer circumference of the medium wound by the winding mechanism becomes long, and furthermore, a weight of the medium itself that is wound by the winding mechanism also becomes heavy, and hence a torque required to rotate the medium wound by the winding mechanism becomes large. Therefore, even if the motor is caused to generate the power for winding the medium with the winding mechanism when the angle of the tension applying member having the specific axis line as the center is outside the specific range, it is difficult to wind the medium with the winding mechanism. If it is difficult to wind the medium with the winding mechanism, an excessive torque applies on the motor and the motor may break down when the motor is caused to generate the power for winding the medium. In the conventional media transporting device, the motor is stopped when it is difficult to wind the medium with the winding mechanism. In other words, in the conventional media transporting device, in some cases, the motor cannot be controlled so that the angle of the tension applying member having the specific axis line as the center falls within the specific range. Therefore, the conventional media transporting device has a problem in that the tension cannot be continuously applied on the medium.

The present invention thus provides a media transporting device and an inkjet printer capable of continuously applying tension on a band-shaped medium for a longer time than in the conventional technique.

Solutions to Problems

A media transporting device of the present invention includes: a medium winding mechanism that executes at least one of unwinding and winding a band-shaped medium which is wound into a roll; a tension applying member that applies tension on the medium by pushing a portion of the medium that is not wound by the medium winding mechanism in a specific direction; and a transport controller that controls transportation of the medium; wherein the medium winding mechanism includes a motor that generates a power for rotating the medium wound into a roll; the medium winding mechanism limits a torque generated between the motor side and the medium side with a specific magnitude as an upper limit; the transport controller causes the motor to generate the power for winding the medium when a predetermined tension is no longer applied on the medium by the tension applying member; and the medium winding mechanism limits the torque to the specific magnitude to apply the predetermined tension on the medium when the motor is caused to generate the power for winding the medium by the transport controller when the predetermined tension is no longer applied on the medium by the tension applying member.

According to such configuration, the media transporting device of the present invention can apply the tension on the medium with the medium winding mechanism by causing the motor to generate the power for winding the medium with the medium winding mechanism and causing the medium winding mechanism to limit the torque, so that even if the tension cannot be applied on the medium by the tension applying member, the tension can be continuously applied on the band-shaped medium for a longer time than in the conventional technique by applying the tension on the medium with the medium winding mechanism.

In the media transporting device of the present invention, the specific direction is a rotating direction having an axis line extending in a width direction of the medium orthogonal to a transporting direction of the medium as a center; the tension applying member can apply tension on the medium by pushing the portion of the medium that is not wound by the medium winding mechanism by its own weight in the rotating direction; the media transporting device includes an angle detector that detects an angle of the tension applying member having the axis line as a center; the tension applying member applies tension on the medium when an angle detected by the angle detector is within at least a specific range; the transport controller stops the generation of the power by the motor for winding the medium with the medium winding mechanism when the angle detected by the angle detector is within the range; and the transport controller causes the motor to generate the power for winding the medium with the medium winding mechanism when the angle detected by the angle detector is outside the range to return the angle of the tension applying member having the axis line as the center to within the range.

According to such configuration, the media transporting device of the present invention causes the motor to stop the generation of the power for winding the medium with the medium winding mechanism when the angle of the tension applying member having the specific axis line as the center is within the specific range, and thus can suppress the load of the motor. When the angle of the tension applying member having the specific axis line as the center is outside the specific range, the media transporting device of the present invention can recover the state of applying the tension on the medium with the tension applying member by returning the angle of the tension applying member to within the specific range. Therefore, the media transporting device of the present invention can suppress the accumulation load of the motor and extend the lifespan of the motor.

The media transporting device of the present invention may further include a transportation roller that transports the portion of the medium that is not wound by the medium winding mechanism toward a side opposite to the medium winding mechanism in the transporting direction of the medium.

According to such configuration, the media transporting device of the present invention can return the angle of the tension applying member to within the specific range even if the angle of the tension applying member having the specific axis line as the center is outside the specific range as a result of the change in the length of the medium from the transportation roller to the medium winding mechanism according to the transportation amount of the medium by the transportation roller while the tension is being applied on the medium by the tension applying member. Therefore, the media transporting device of the present invention can maintain the state of applying the tension on the medium by the tension applying member without being influenced by the transportation amount of the medium by the transportation roller.

The media transporting device of the present invention may further include: an unwinding mechanism that unwinds the medium wound into a roll; and a winding mechanism that winds the medium unwound by the unwinding mechanism as the medium winding mechanism.

According to such configuration, the media transporting device of the present invention can apply tension on the band-shaped medium by the cooperative operation of the winding mechanism and the unwinding mechanism by causing the motor to generate the power for winding the medium with the unwinding mechanism when causing the motor to generate the power for winding the medium with the winding mechanism.

An inkjet printer of the present invention includes the media transporting device described above; and an inkjet head that executes printing by ink on the medium applied with tension by the media transporting device.

According to such configuration, the inkjet printer of the present invention can continue the printing for a longer time than in the conventional technique by executing the printing on the medium in which the tension is continuously applied for a longer time than in the conventional technique.

Effects of the Invention

The media transporting device and the inkjet printer of the present invention can continuously apply tension on a band-shaped medium for a longer time than in the conventional technique.

DESCRIPTION OF EMBODIMENTS

Embodiments of the present invention will be hereinafter described using the drawings.

First, a configuration of an inkjet printer according to the present embodiment will be described.

Figure 1:
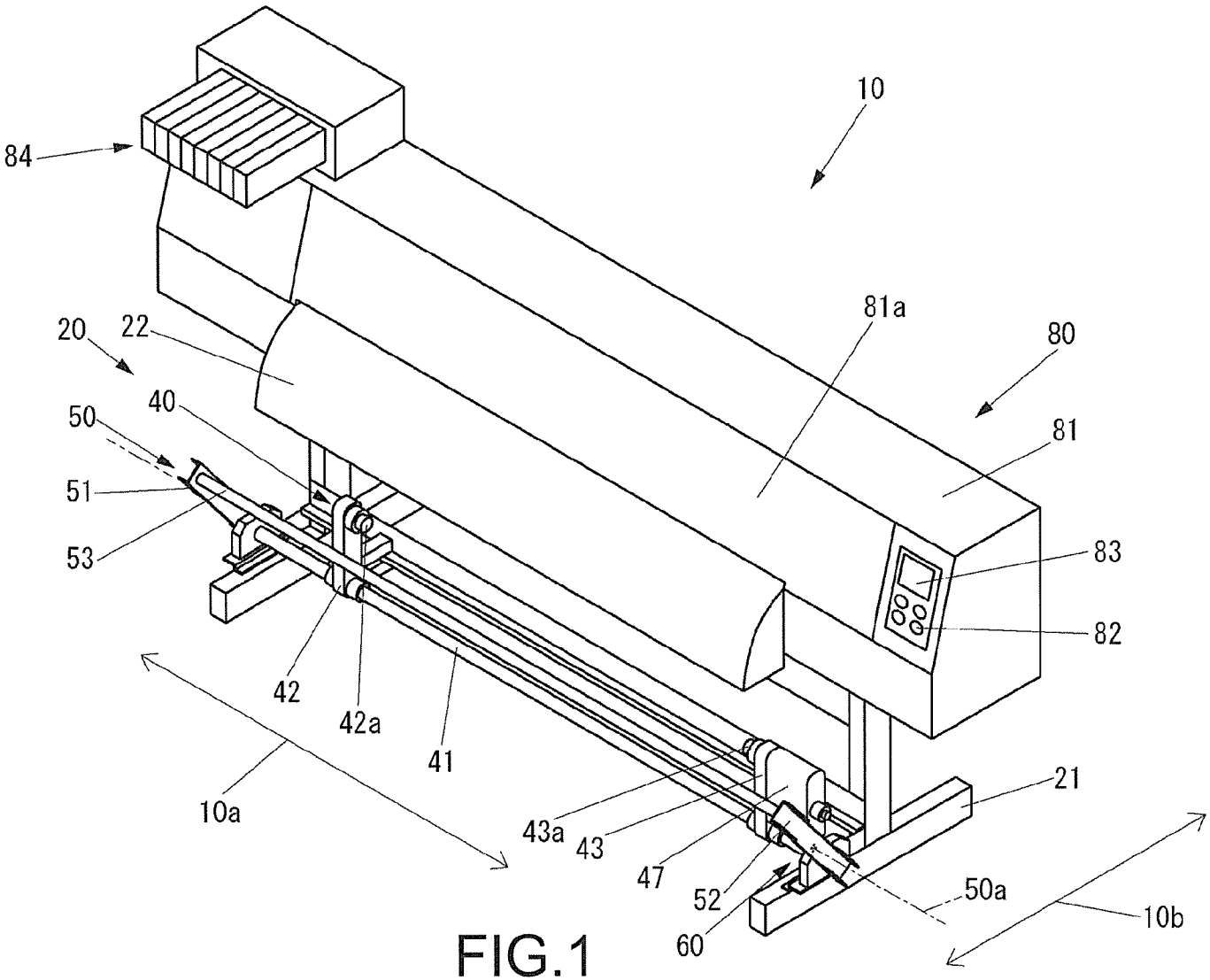
FIG. 1 is a perspective view of an outer appearance of an inkjet printer according to one embodiment of the present invention when observed from an upper right side of a front surface.
Figure 2:
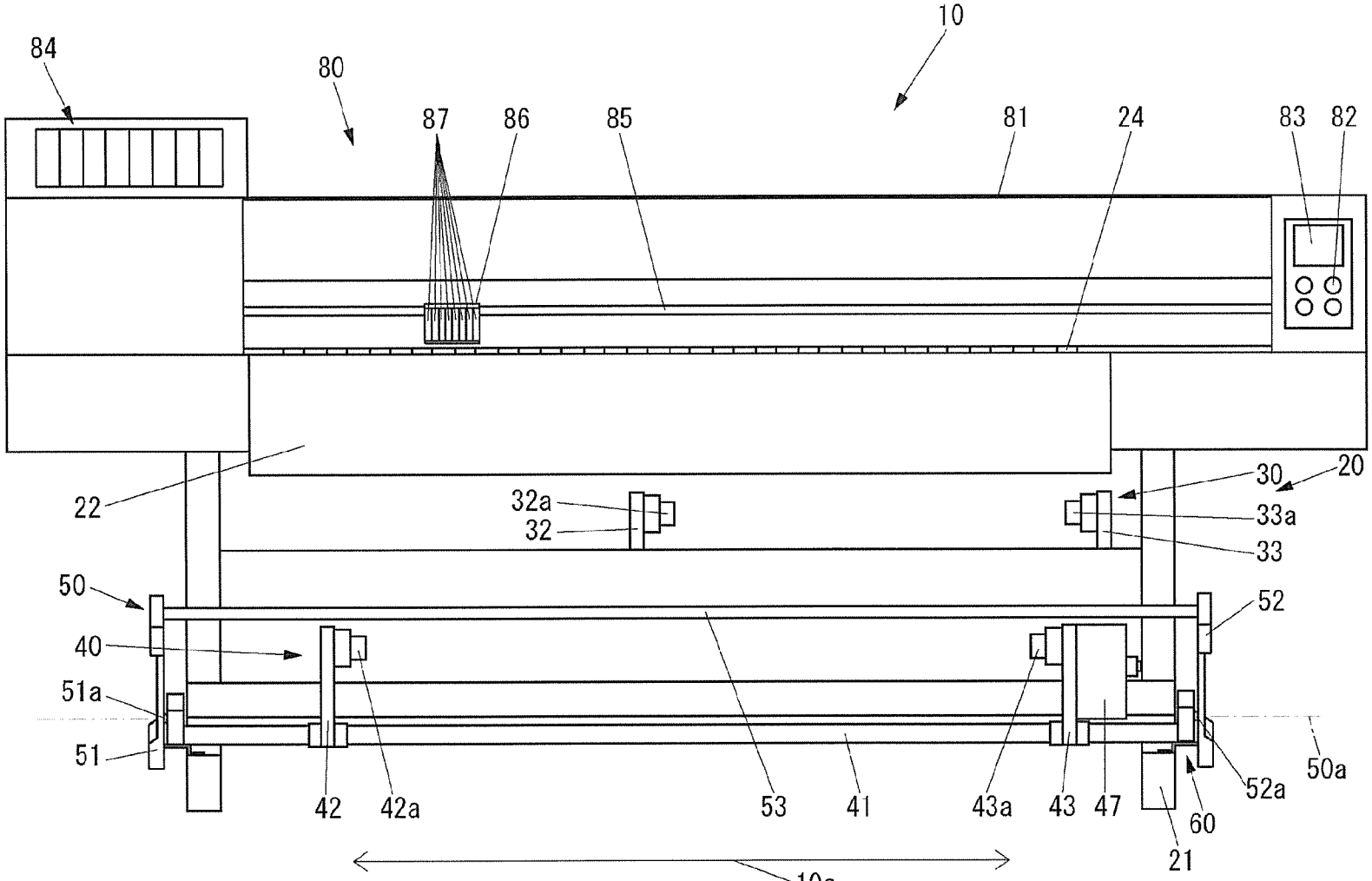
FIG. 2 is a front view of the inkjet printer shown in FIG. 1 with a front cover detached.
Figure 3:
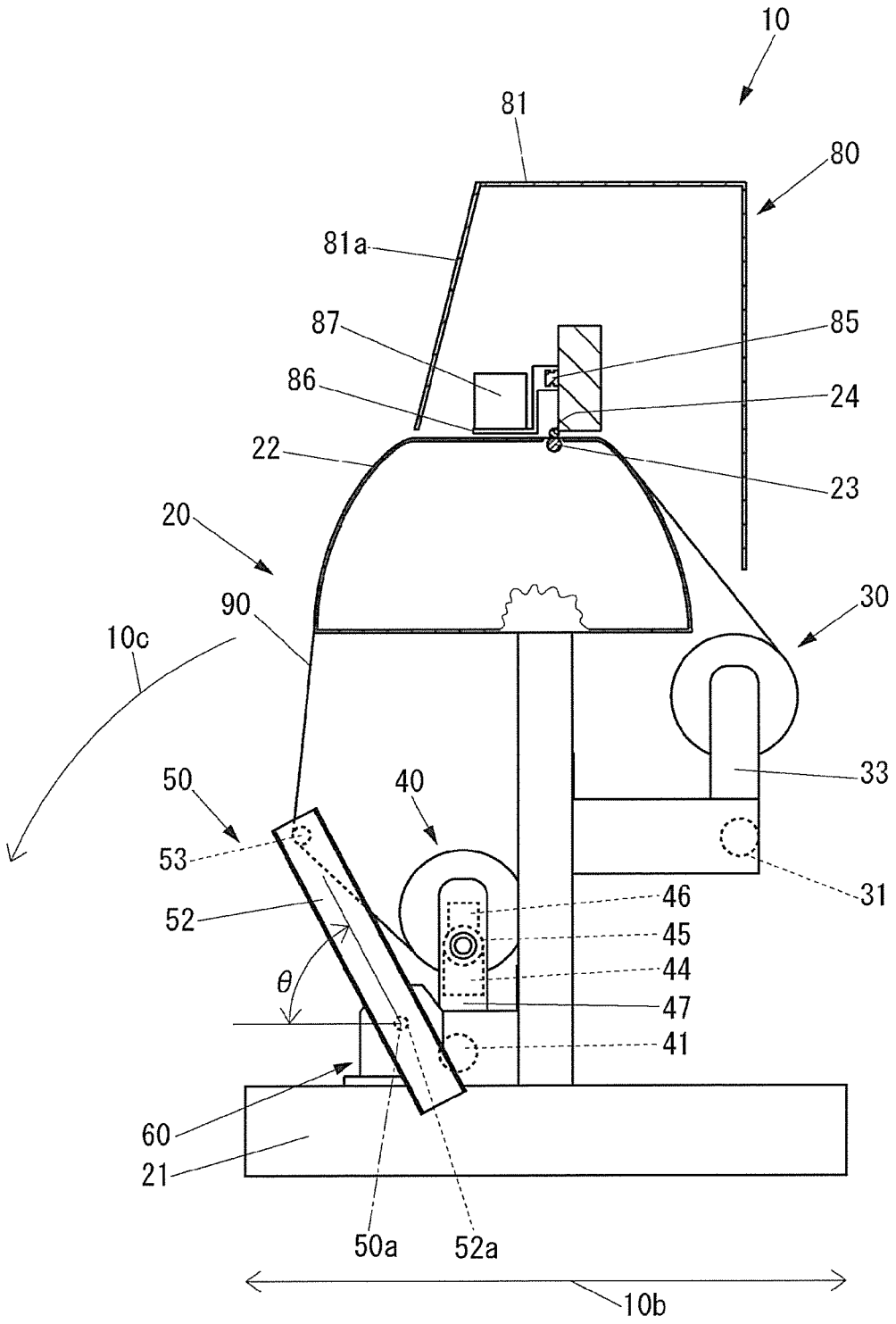
FIG. 3 is a side cross-sectional view of the inkjet printer shown in FIG. 1 when a tension is applied on a printing medium by a tension applying member.

FIG. 1 is a perspective view of an outer appearance of an inkjet printer 10 according to the present embodiment when observed from an upper right side of a front surface. FIG. 2 is a front view of the inkjet printer 10 with a front cover 81*a* (see FIG. 1) detached. FIG. 3 is a side cross-sectional view of the inkjet printer 10 when tension is applied on a printing medium 90 by a tension applying member 50.

As shown in FIGS. 1 to 3, the inkjet printer 10 includes a media transporting device 20 that transports the printing medium 90, which is a band-shaped medium, and a main body 80 that is installed on the media transporting device 20 to execute printing by ink.

The media transporting device 20 includes a leg 21 that is installed on a floor; a platen 22 that supports the printing medium 90, on which printing is to be executed by the main body 80; a transportation roller 23 that transports the printing medium 90 in a sub-scanning direction, indicated with an arrow 10*b*, orthogonal to a main scanning direction, indicated with an arrow 10*a*; a pinch roller 24 that sandwiches the printing medium 90 with the transportation roller 23; an unwinding mechanism 30 serving as a medium winding mechanism that has the printing medium 90 wound therearound into a roll and that unwinds the printing medium 90 toward the main body 80; a winding mechanism 40 serving as a medium winding mechanism that has the printing medium 90 wound therearound into a roll and that winds the printing medium 90, on which printing is executed by the main body 80; a tension applying member 50 that is rotatable with an axis line 50*a*, which extends in a width direction of the printing medium 90 orthogonal to a transporting direction of the printing medium 90, that is, the main scanning direction as the center and that applies tension on the printing medium 90; and an angle detection device 60 serving as an angle detector that detects an angle θ of the tension applying member 50 having the axis line 50*a* as the center. The unwinding mechanism 30, the winding mechanism 40, the tension applying member 50, and the angle detection device 60 are supported by the leg 21. The platen 22, the transportation roller 23, and the pinch roller 24 are extended in the main scanning direction.

The main body 80 includes a case 81 with a detachable front cover 81*a* for covering the interior of the main body 80, an operation section 82, which is an input device, such as a button to which various operations are input, a display section 83, which is a display device, such as an LCD (Liquid Crystal Display) for displaying various information, a plurality of ink tanks 84 containing ink, a guide rail 85 extending in the main scanning direction indicated with the arrow 10*a*, a carriage 86 supported by the guide rail 85 so as to be movable in the main scanning direction, and a plurality of inkjet heads 87 mounted on the carriage 86 to discharge ink toward the printing medium 90.

As shown in FIGS. 2 and 3, the unwinding mechanism 30 includes a rail 31 extending in the main scanning direction indicated with the arrow 10*a* and supported by the leg 21, and a roll holder 32 and a roll holder 33 that rotatably support a paper core (not shown) around which the printing medium 90 before printing by the inkjet head 87 is wound, by sandwiching the paper core from both sides. The rail 31 supports the roll holder 32 and the roll holder 33 in a manner movable in the main scanning direction. In other words, the roll holder 32 and the roll holder 33 can change the distance between them in the main scanning direction in accordance with the width of the printing medium 90 to use. The roll holder 32 includes a rotating shaft 32*a* inserted into a hole at an end of the paper core. Similarly, the roll holder 33 includes a rotating shaft 33*a* inserted into a hole at an end of the paper core. The rotating shaft 32*a* and the rotating shaft 33*a* are rotatable with a center axis extending in the main scanning direction as the center.

As shown in FIGS. 1 to 3, the winding mechanism 40 includes a rail 41 extending in the main scanning direction indicated with the arrow 10*a* and supported by the leg 21, and a roll holder 42 and a roll holder 43 that rotatably support a paper core (not shown) around which the printing medium 90 after printing by the inkjet head 87 is wound, by sandwiching the paper core from both sides. The rail 41 supports the roll holder 42 and the roll holder 43 in a manner movable in the main scanning direction. In other words, the roll holder 42 and the roll holder 43 can change the distance between them in the main scanning direction in accordance with the width of the printing medium 90 to use. The roll holder 42 includes a rotating shaft 42*a* inserted into a hole at an end of the paper core. Similarly, the roll holder 43 includes a rotating shaft 43*a* inserted into a hole at an end of the paper core. The rotating shaft 42*a* and the rotating shaft 43*a* are rotatable with a center axis extending in the main scanning direction as the center.

Figure 4:
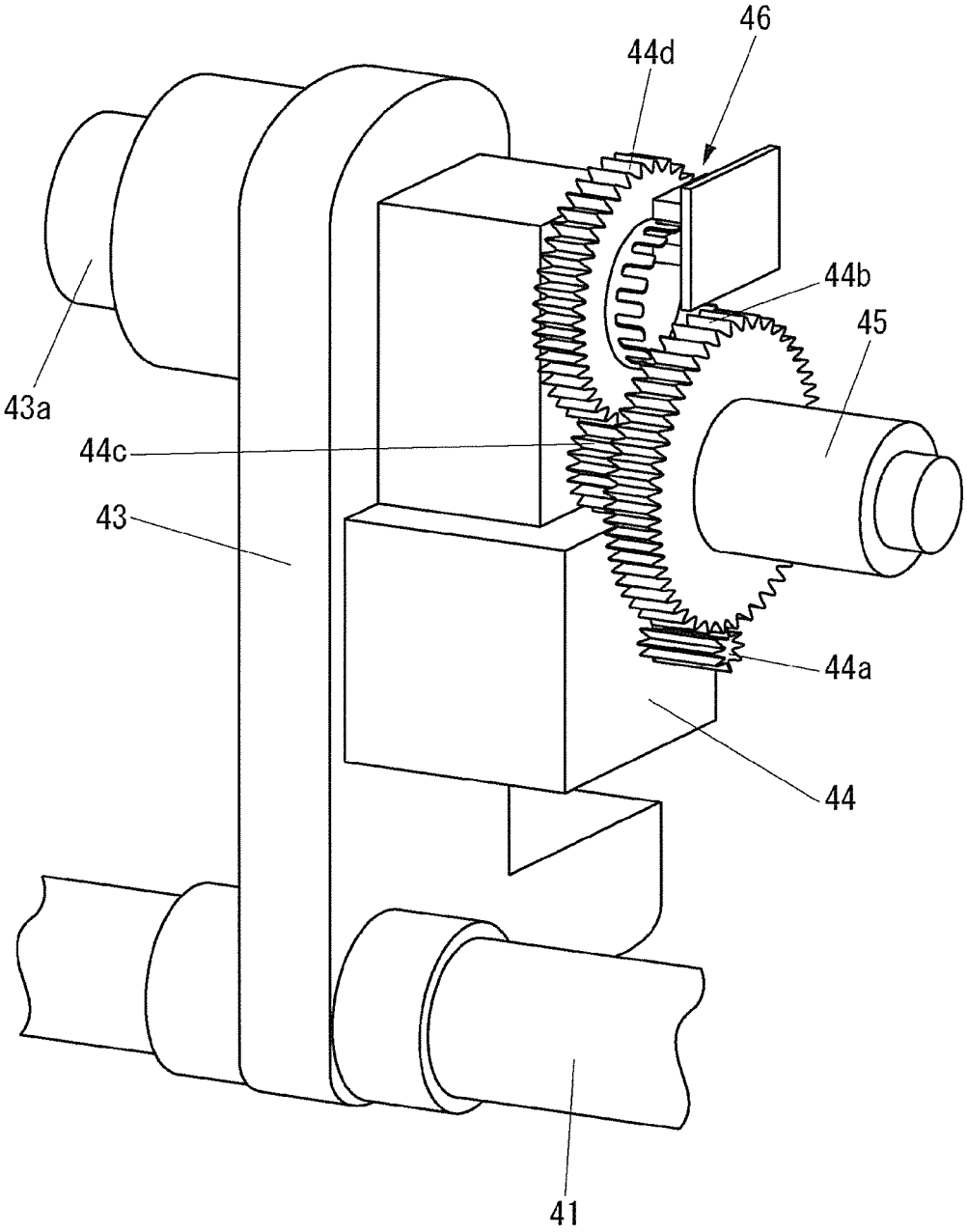
FIG. 4 is a perspective view of a vicinity of a roll holder shown in FIG. 1 when observed from an upper right side of the front surface with the cover detached.

FIG. 4 is a perspective view of a vicinity of the roll holder 43 when observed from an upper right side of the front surface with the cover 47 (see FIG. 1) detached.

As shown in FIGS. 1 to 4, the winding mechanism 40 includes a motor 44 that generates a driving force for rotating the rotation shaft 43*a* of the roll holder 43, that is, a power for rotating the printing medium 90 wound into a roll around the paper core rotatably supported by the roll holder 43; a torque limiter 45 serving as a torque limiting mechanism configuring a part of a transmission mechanism of the driving force from the motor 44 to the rotation shaft 43*a* and shielding the connection when an excessive load is applied; an encoder 46 that detects the rotation of the rotating shaft 43*a*; and a cover 47 that covers the motor 44, the torque limiter 45, and the encoder 46.

To transmit the power of the motor 44 to the paper core, around which the printing medium 90 is wound, the winding mechanism 40 includes a gear supporting shaft 44*a* included by the motor 44, a first gear 44*b* that gears with the gear supporting shaft 44*a*, a second gear 44*c* that rotates about a rotation axis same as the rotation axis of the first gear 44*b* and of which diameter is smaller than that of the first gear 44*b*, and a third gear 44*d* that gears with the second gear 44*c* and that rotates about a rotation axis same as the rotation axis of the paper core around which the printing medium 90 is wound. The torque limiter 45 limits the torque generated between the first gear 44*b* and the second gear 44*c*, and operates to prevent the rotation of the first gear 44*b* from being transmitted to the second gear 44*c* when a torque of a specific magnitude is generated.

As described above, the torque limiter 45 limits the torque generated between the motor 44 side and the printing medium 90 side with a specific magnitude as an upper limit. The torque limiter 45 can allow the upper limit of the torque generated between the motor 44 side and the printing medium 90 side to be adjusted.

As shown in FIGS. 1 to 3, the tension applying member 50 includes an arm 51 rotatably supported by the leg 21 with a shaft 51*a* extending on the axis line 50*a* as a center, an arm 52 rotatably supported by the leg 21 with a shaft 52*a* extending on the axis line 50*a* as a center, and a tension bar 53 extending in the main scanning direction and being provided to be brought into contact with the printing medium 90. The tension bar 53 is supported by the arm 51 and the arm 52. The tension applying member 50 can apply tension on the printing medium 90 by pushing a portion of the printing medium 90 that is not wound by the winding mechanism 40 by its own weight in a rotating direction indicated with an arrow 10*c* having the axis line 50*a* as the center.

The tension applying member 50 is adapted such that an angle θ does not become smaller than, for example, 52° by the action of a stopper (not shown). The tension applying member 50 is adapted such that the angle θ is maintained within a specific range (e.g., range from 62.5° to 70°) of a range in which the tension can be applied on the printing medium 90 by the winding of the printing medium 90 by the winding mechanism 40, as will be described later.

Figure 5:
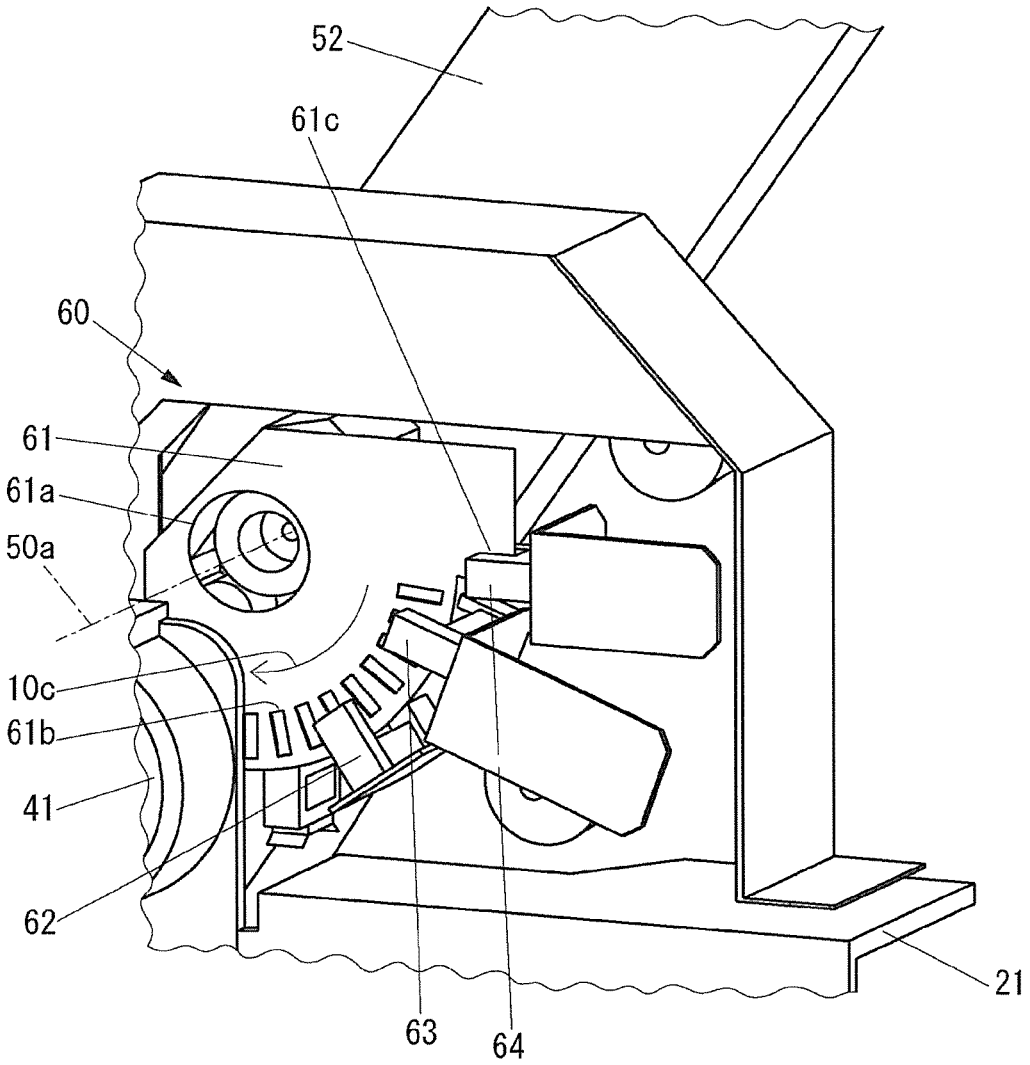
FIG. 5 is a perspective view of a part of the media transporting device shown in FIG. 1 when observed from an upper left side of the front surface with a configuration of an interior of an angle detection device exposed.

FIG. 5 is a perspective view of a part of the media transporting device 20 when observed from an upper left side of the front surface with the configuration of the interior of the angle detection device 60 exposed.

As shown in FIG. 5, the angle detection device 60 includes a plate 61 fixed to the shaft 52*a* of the arm 52 (not shown in FIG. 5; see FIG. 2); and a photo-interrupter 62, a photo-interrupter 63, and a photo-interrupter 64 fixed with respect to the leg 21. The plate 61 includes a hole 61*a*, to which the shaft 52*a* is inserted, and a plurality of slits 61*b* arranged side by side in the rotating direction indicated with the arrow 10*c* and provided to be detected by the photo-interrupter 62 and the photo-interrupter 63. The plate 61 includes a detecting portion 61*c* to be detected by the photo-interrupter 64. In other words, the angle detection device 60 is an encoder that detects the angle θ (see FIG. 3).

Figure 6:
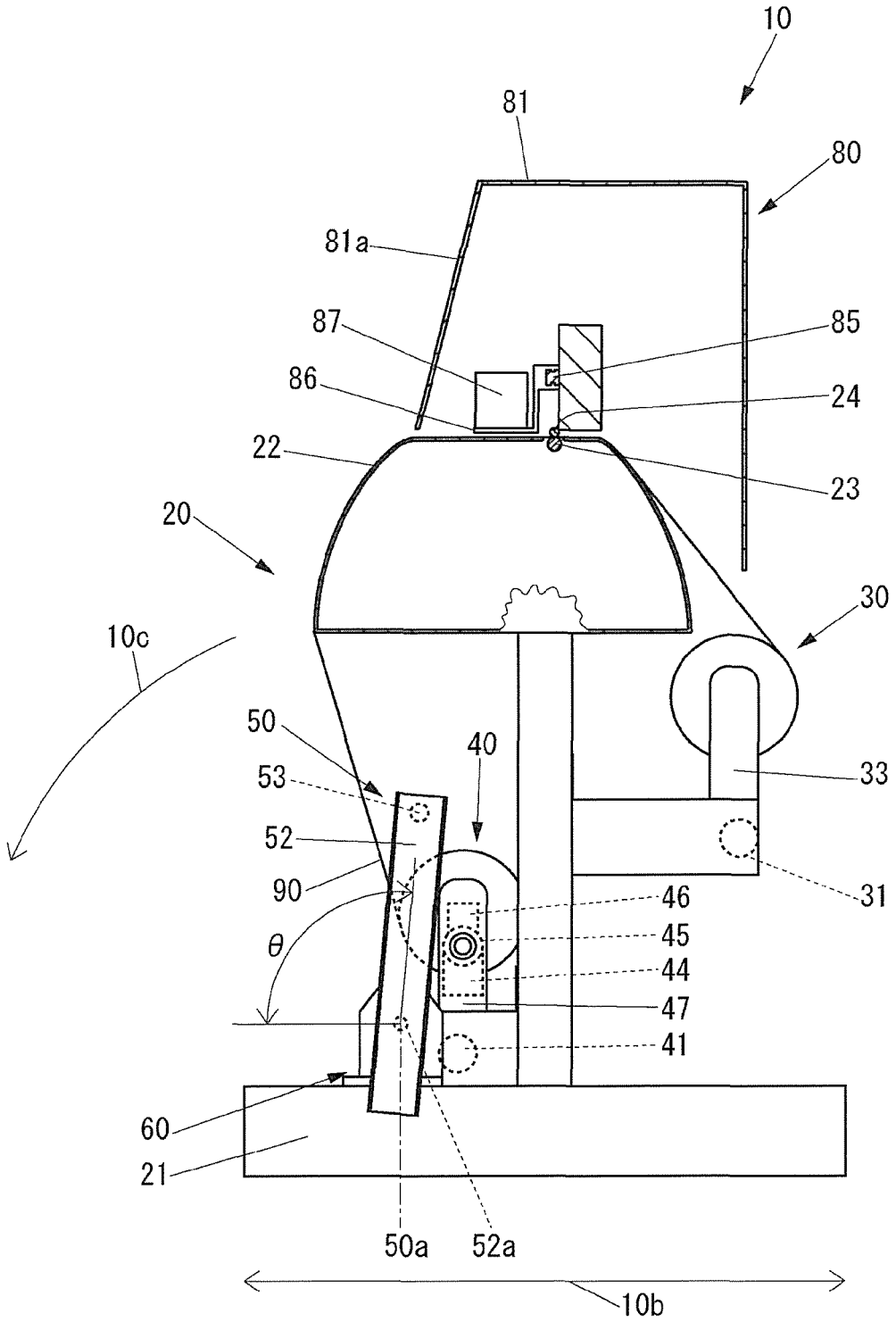
FIG. 6 is a side cross-sectional view of the inkjet printer shown in FIG. 1 when the tension applying member is located at an evacuating position.

FIG. 6 is a side cross-sectional view of the inkjet printer 10 when the tension applying member 50 is located at an evacuating position.

As shown in FIG. 6, the tension applying member 50 is adapted such that the angle θ is no greater than, for example, 95° by the action of the stopper (not shown). The position of the tension applying member 50 shown in FIG. 6 is referred to as the evacuating position. The tension applying member 50 cannot be brought into contact with the printing medium 90 when located at the evacuating position, and hence cannot apply tension on the printing medium 90.

Figure 7:
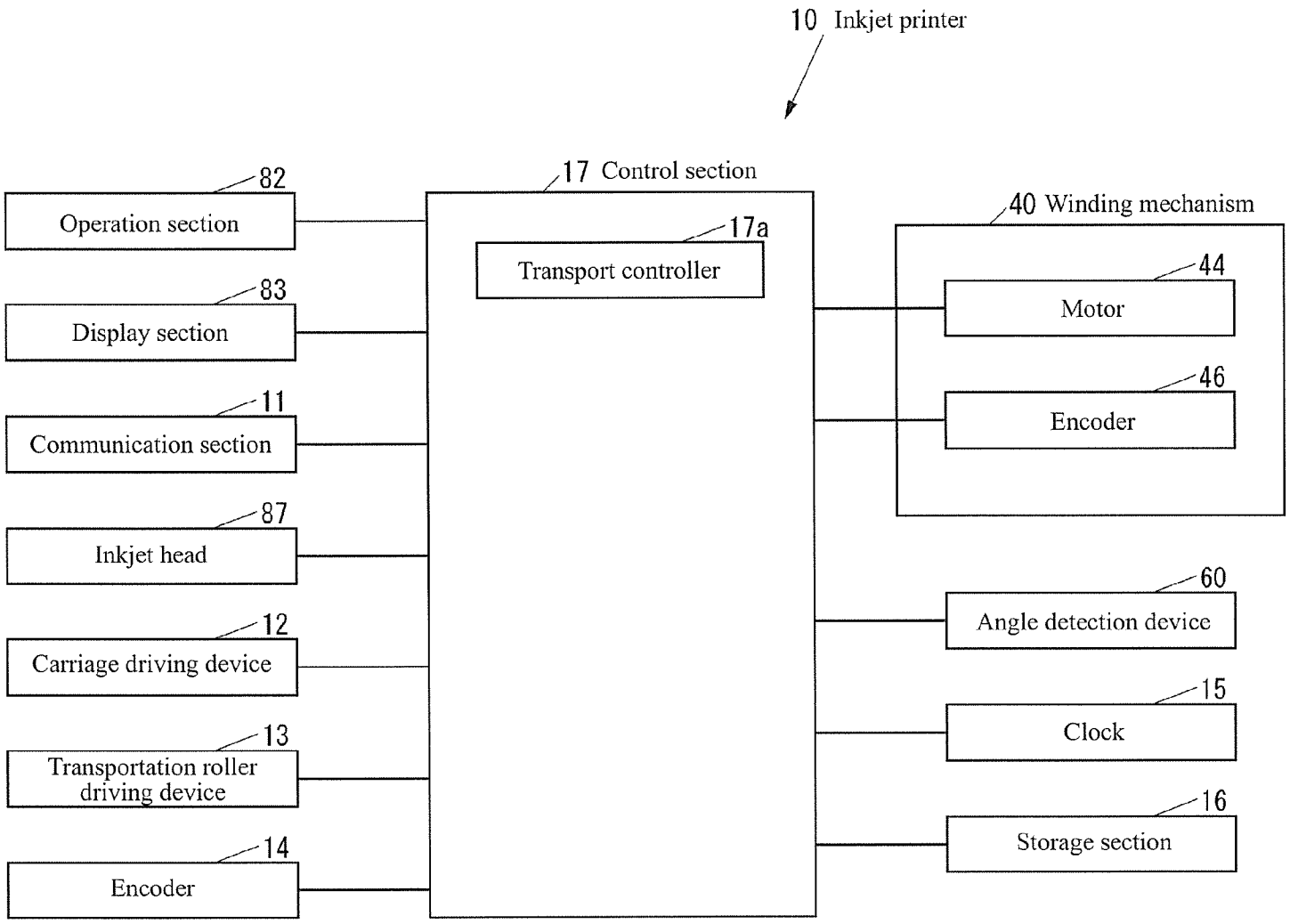
FIG. 7 is a block diagram of the inkjet printer shown in FIG. 1.

FIG. 7 is a block diagram of the inkjet printer 10.

As shown in FIG. 7, the inkjet printer 10 includes the operation section 82 and the display section 83 described above, a communication section 11, which is a communication device, that carries out communication with an external device such as a PC (Personal Computer), the inkjet head 87 described above, a carriage driving device 12 that moves the carriage 86 (see FIG. 2) in the main scanning direction indicated with the arrow 10*a* (see FIG. 2) along the guide rail 85 (see FIG. 2), a transportation roller driving device 13 that rotates the transportation roller 23 (see FIG. 3), an encoder 14 that detects a rotation amount of the transportation roller 23, the motor 44, an encoder 46 and the angle detection device 60 described above, a clock 15, a storage section 16, which is a storage device, such as EEPROM (Electrically Erasable Programmable Read Only Memory) that stores various data, and a control section 17 that controls the entire inkjet printer 10.

The length of the printing medium 90 transported by the transportation roller 23 is the same as a length of accumulation in a circumferential direction of points in the transportation roller 23 brought into contact with the printing medium 90, and hence can be calculated based on a diameter of the transportation roller 23 and a detection value of the encoder 14. Specifically, assuming that the length of the printing medium 90 transported by the transportation roller 23 is L1, the diameter of the transportation roller 23 is R1, and the rotation angle obtained from the detection value of the encoder 14 is θ1 [rad], L1 is "θ1×R1".

The control section 17 includes, for example, a CPU (Central Processing Unit), a ROM (Read Only Memory) in which programs and various types of data are stored in advance, and a RAM (Random Access Memory) used as a work region of the CPU. The CPU executes the program stored in the ROM or the storage section 16.

The control section 17 has a function of a transport controller 17*a* that controls the transportation of the printing medium 90 by executing the program stored in the ROM or the storage section 16.

Next, a description will be made on the operation of the inkjet printer 10.

When receiving externally transmitted print data via the communication section 11, the control section 17 of the inkjet printer 10 controls the inkjet head 87, the carriage driving device 12, the transportation roller driving device 13, and the winding mechanism 40 based on the print data to execute printing by the inkjet head 87.

Specifically, the control section 17 controls the carriage driving device 12 and moves the carriage 86 in the main scanning direction indicated with the arrow 10*a* along the guide rail 85, thus relatively moving the inkjet head 87 mounted on the carriage 86 in the main scanning direction with respect to the printing medium 90. At this time, the control section 17 executes printing in the main scanning direction by discharging ink droplets toward the printing medium 90 with the inkjet head 87. The control section 17 then controls the transportation roller driving device 13 and rotates the transportation roller 23 each time the printing in the main scanning direction is terminated, thus moving the printing medium 90 sandwiched by the transportation roller 23 and the pinch roller 24 in the sub-scanning direction indicated with the arrow 10*b*. In other words, the control section 17 changes the printing position by the inkjet head 87 in the sub-scanning direction on the printing medium 90 by relatively moving the inkjet head 87 and the printing medium 90 in the sub-scanning direction. The control section 17 then again executes printing in the main scanning direction at a new printing position in the sub-scanning direction.

When the printing medium 90 is transported by the transportation roller 23, the printing medium 90 wound around the paper core rotatably supported by the roll holder 32 and the roll holder 33 of the unwinding mechanism 30 is unwound from the unwinding mechanism 30.

Furthermore, when the printing medium 90 is transported by the transportation roller 23, the printing medium 90 after the printing by the inkjet head 87 is applied with tension by at least one of the winding mechanism 40 and the tension applying member 50, and is also wound by the winding mechanism 40.

Figure 8:
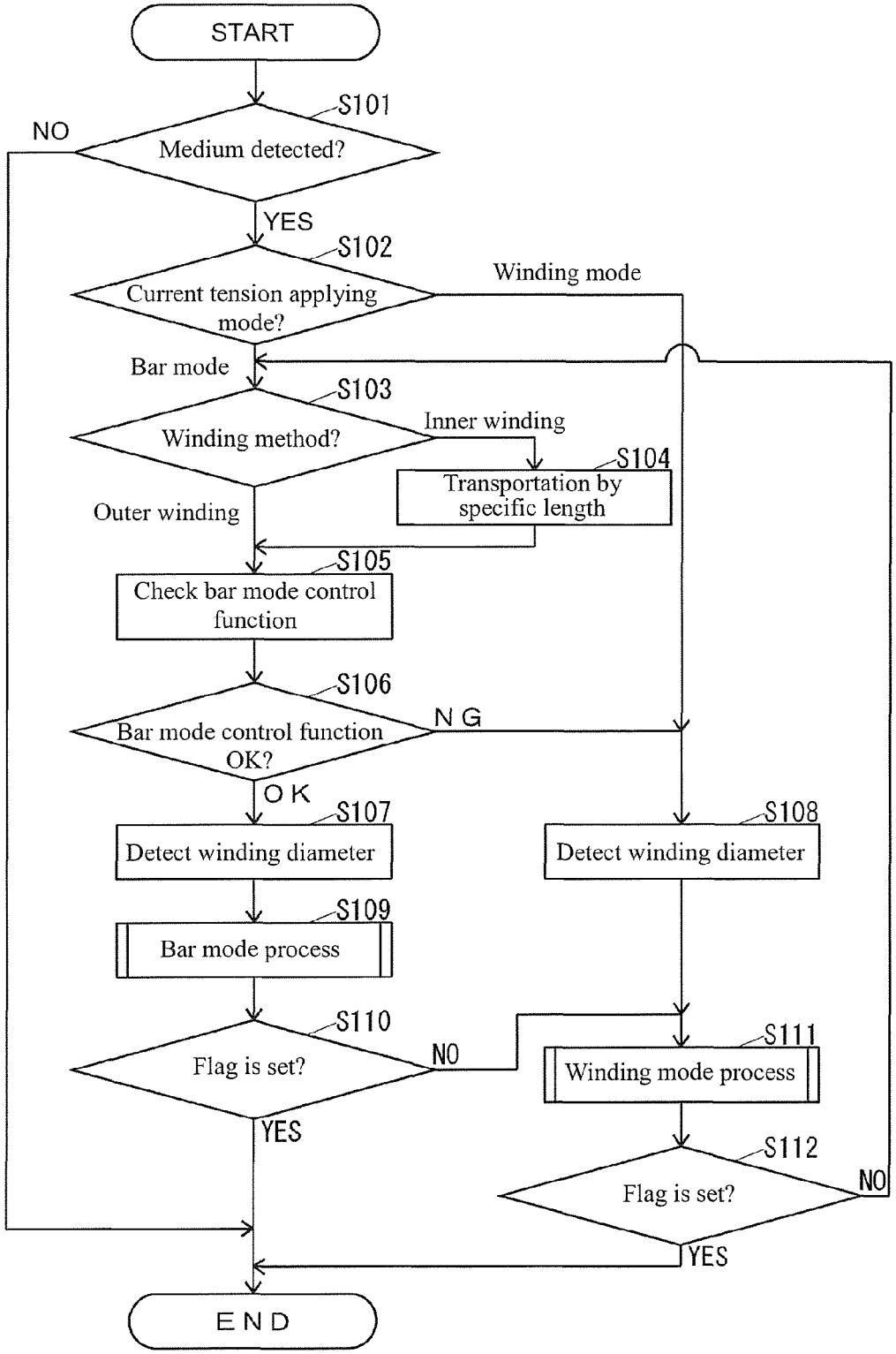
FIG. 8 is a flowchart of an operation of a transport controller shown in FIG. 7.

FIG. 8 is a flowchart of an operation of the transport controller 17*a*.

The transport controller 17*a* executes the operation shown in FIG. 8 when the operation of the control section 17 of the inkjet printer 10 is started (when power of the inkjet printer 10 is turned ON).

As shown in FIG. 8, the transport controller 17*a* determines whether or not the printing medium 90 is wound around the paper core rotatably supported by the winding mechanism 40 before the ink is discharged by the inkjet head 87 (S101). When the printing medium 90 is not wound around the paper core, the transport controller 17*a* terminates the processes shown in FIG. 8.

When the printing medium 90 is wound around the paper core, the transport controller 17*a* determines a current tension applying mode for applying tension on the printing medium 90 after the process of S101 (S102). The tension applying mode includes a "bar mode" in which tension is applied on the printing medium 90 by the tension applying member 50, and a "winding mode" in which tension is applied on the printing medium 90 by the winding mechanism 40. The control section 17 can accept a specification of either the "bar mode" or the "winding mode" through the operation section 82.

When determining that the current tension applying mode is the "winding mode" in S102, the transport controller 17*a* proceeds to the detection of the winding diameter (S108) for a winding mode process.

When determining that the current tension applying mode is the "bar mode" in S102, the transport controller 17*a* determines a winding method of the printing medium 90 around the paper core (S103). The winding method of the printing medium 90 around the paper core includes "outer winding" in which the printing medium 90 is wound around the paper core so that the tension bar 53 makes contact with a portion of the printing medium 90 that becomes an inner surface when wound around the paper core, as shown in FIG. 3, and "inner winding" in which the printing medium 90 is wound around the paper core so that the tension bar 53 makes contact with a portion of the printing medium 90 that becomes an outer surface when wound around the paper core, as shown in FIG. 9.

When determining that the winding method of the printing medium 90 around the paper core is the "inner winding" in S103, the transport controller 17*a* transports the printing medium 90 with the transportation roller 23 by a specific length, for example, greater than or equal to 300 mm (S104).

The reason why the printing medium 90 is transported by a specific length when determined that the winding method of the printing medium 90 around the paper core is the "inner winding" will be described below.

Figure 9:
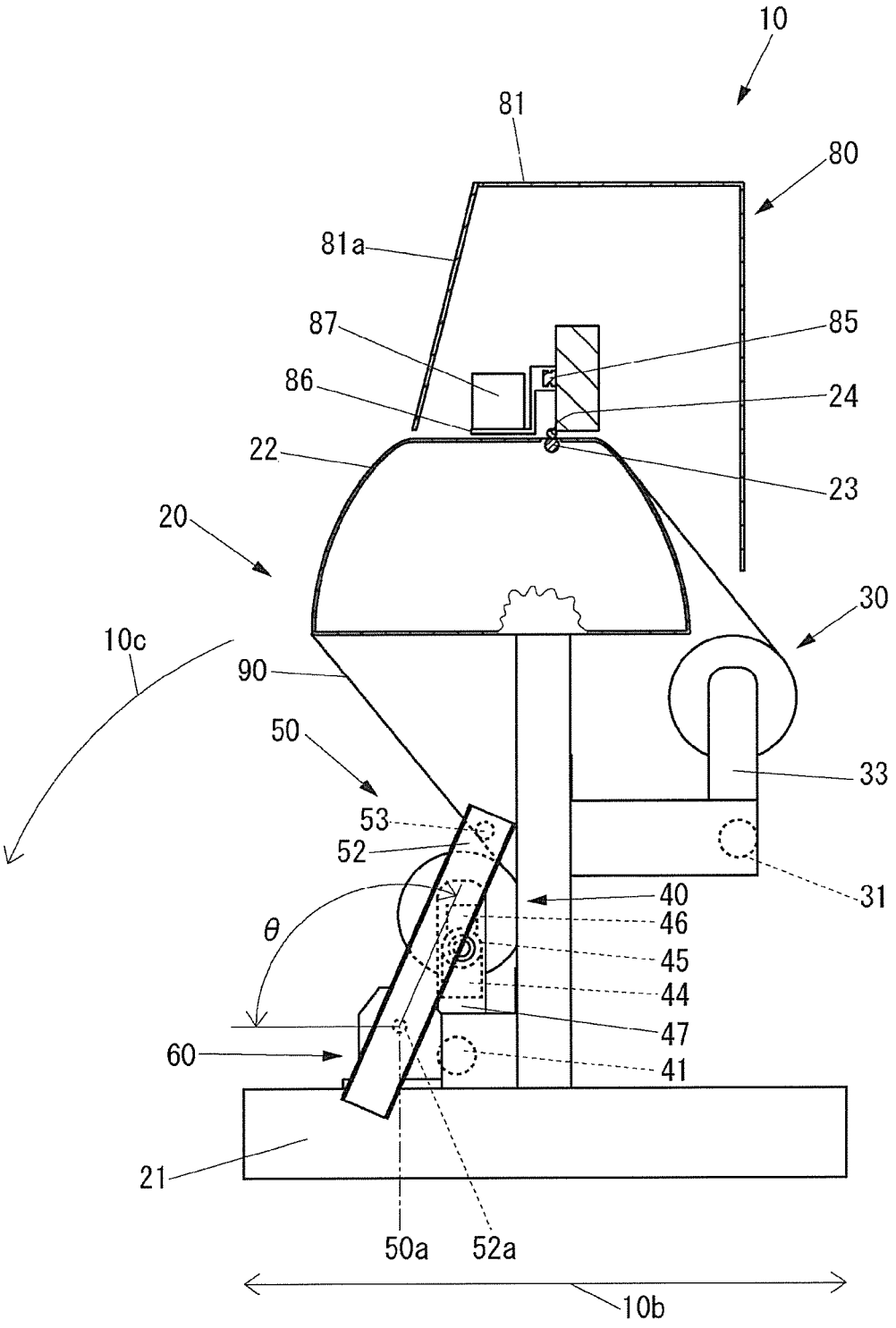
FIG. 9 is a side cross-sectional view of the inkjet printer shown in FIG. 1 when a tension bar is brought into contact with the printing medium with an angle of the tension applying member having a specific axis line as a center exceeding an upper limit of a specific range when a winding method of the printing medium on a paper core is "inner winding".

FIG. 9 is a side cross-sectional view of the inkjet printer 10 when the tension bar 53 is brought into contact with the printing medium 90 with the angle θ of the tension applying member 50 having the axis line 50*a* as the center exceeding the upper limit of a specific range when the winding method of the printing medium 90 around the paper core is the "inner winding".

The "specific range" and the "specific length" are set so that the angle θ falls within the specific range as shown in FIG. 3, when the printing medium 90 of a specific length is transported by the transportation roller 23 while the angle θ exceeds the upper limit of the specific range as shown in FIG. 9. Therefore, the process of S104 is provided to have the angle θ within the specific range when the angle θ exceeds the upper limit of the specific range.

The transport controller 17*a* carries out a check of a bar mode control function when determining that the winding method of the printing medium 90 around the paper core is the "outer winding" in S103 and after the printing medium 90 is transported by a specific length in S104 (S105). Specifically, in S105, initialization of the encoder of the angle detection device 60, operation check of the photo-interrupters 62, 63, 64, and the like are carried out.

The transport controller 17*a* determines whether the state of the bar mode control function obtained in S105 is "OK", which is a state where a bar mode process, to be described later, can be carried out, or "NG", which is a state where the bar mode process cannot be carried out (S106).

When determining that the state of the bar mode control function is "NG", the transport controller 17*a* proceeds to the detection of the winding diameter (S108) for the winding mode process.

On the other hand, when determining that the state of the bar mode control function is "OK", the transport controller 17*a* proceeds to the detection of the winding diameter (S107) for the bar mode process.

In S107 and S108, the transport controller 17*a* first stops the transportation of the printing medium 90 by the transportation roller 23, and causes the motor 44 to generate the power for winding the printing medium 90 with the winding mechanism 40, thereby realizing a state in which the tension is applied on the printing medium 90 by the winding mechanism 40 where the torque is limited by the torque limiter 45. Then, the transport controller 17*a* transports the printing medium 90 with the transportation roller 23 by a predetermined length. The transport controller 17*a* can determine the length of the printing medium 90 transported by the transportation roller 23 based on the rotation amount of the transportation roller 23 detected by the encoder 14, as described above. Even while the printing medium 90 is being transported by the transportation roller 23, the printing medium 90 is wound by the winding mechanism 40 by an amount by which the printing medium 90 is transported by the transportation roller 23 with the tension applied thereon by the winding mechanism 40 where the torque is limited by the torque limiter 45. After the transportation of the printing medium 90 by the transportation roller 23 is terminated, the transport controller 17*a* stops the motor 44. The transport controller 17*a* can determine a winding diameter based on the rotation amount of the rotating shaft 43*a* detected by the encoder 46 while the printing medium 90 is transported by the transportation roller 23 by the predetermined length, and the length of the printing medium 90 transported by the transportation roller 23. Specifically, assuming that the winding diameter (diameter) is R2, the length of the printing medium 90 transported by the transportation roller 23 is L2, and the rotation angle obtained from the rotation amount of the rotating shaft 43*a* detected by the encoder 46 is θ2 [rad], R2 is "$2 \times L2/\theta 2$".

After the process of S107 is terminated, the transport controller 17*a* executes the bar mode process, which is the process of "bar mode" (S109).

Figure 10:
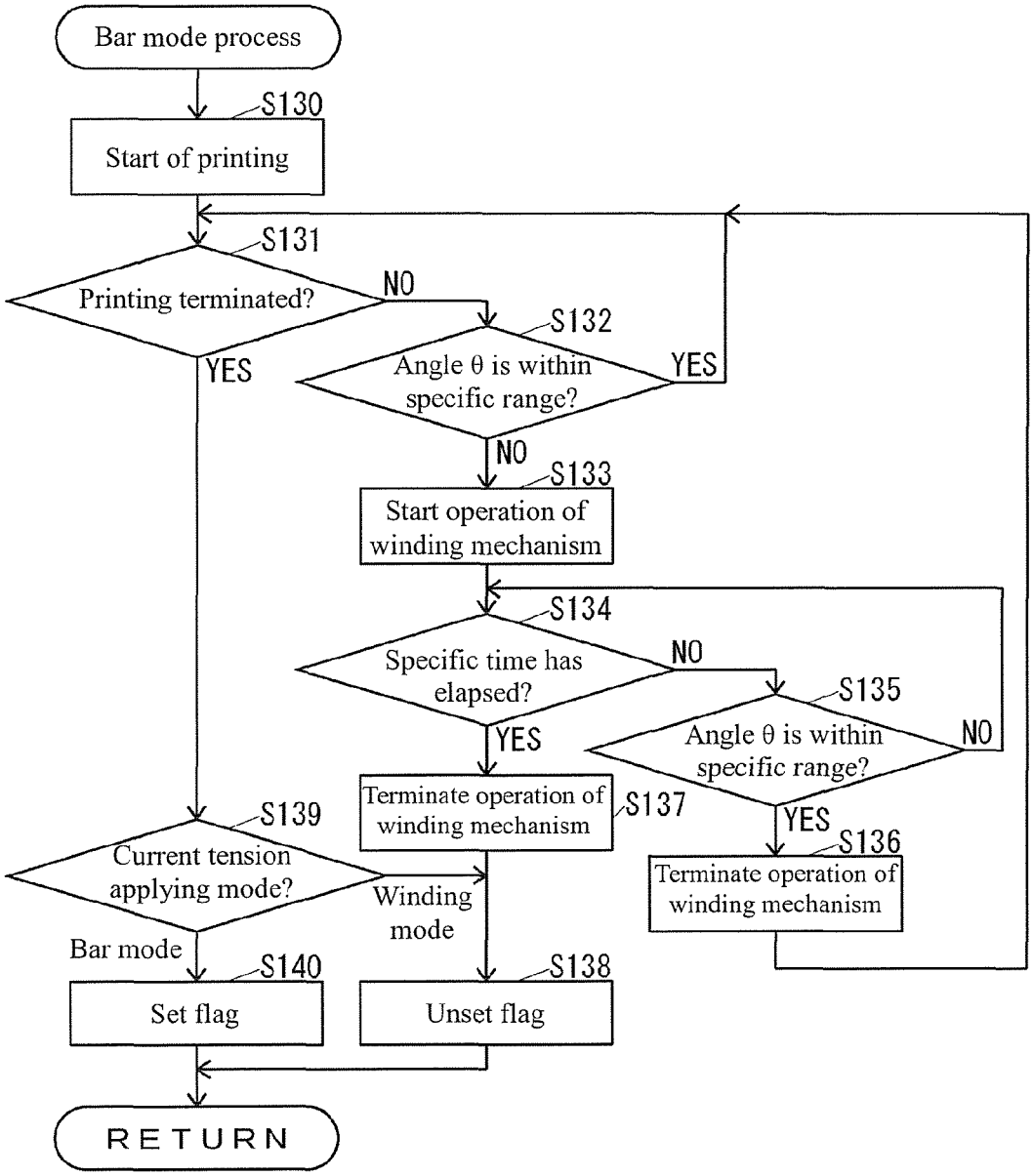
FIG. 10 is a flowchart of a bar mode process shown in FIG. 8.

FIG. 10 is a flowchart of the bar mode process shown in FIG. 8.

As shown in FIG. 10, the control section 17 carries out the start of printing (S130). When determining that the printing is terminated in S131, the transport controller 17*a* determines the current tension applying mode (S139).

When determining that the current tension applying mode is the "bar mode" in S139, the transport controller 17*a* sets a flag (S140), and terminates the bar mode process shown in FIG. 10.

When determining that the current tension applying mode is the "winding mode" in S139, the transport controller 17*a* unsets a flag (S138), and terminates the bar mode process shown in FIG. 10.

When determining that the printing is not terminated in S131, the transport controller 17*a* determines whether or not the angle θ detected by the angle detection device 60 is within the specific range (S132). Whether or not the angle θ is within the specific range can be determined by the detection values from the photo-interrupter 62 and the photo-interrupter 63.

When determining that the angle θ is within the specific range in S132, the transport controller 17*a* executes the process of S131.

When determining that the angle θ is not within the specific range in S132, the transport controller 17*a* causes the motor 44 to generate the power for winding the printing medium 90 with the winding mechanism 40 to start the operation of the winding mechanism 40 (S133).

The transport controller 17*a* controls the rotation speed of the motor 44 according to the winding diameter to have the length of the printing medium 90 wound in a unit time by the winding mechanism 40, that is, the winding speed constant irrespective of the winding diameter. Specifically, assuming that the target rotation speed of the motor 44 is V, the current winding diameter is R, the rotation speed set beforehand as the rotation speed in a state where the printing medium 90 is not yet wound around the paper core rotatably supported by the winding mechanism 40 is Vr, and the diameter (hereinafter referred to as "reference winding diameter") of the paper core rotatably supported by the winding mechanism 40 is Rr, V is "Vr×(Rr/R)".

Furthermore, the transport controller 17*a* controls a rotation acceleration of the motor 44 according to the winding diameter to have an acceleration of the winding speed, that is, a winding acceleration constant irrespective of the winding diameter. Specifically, assuming that the target rotation acceleration of the motor 44 is A, the current winding diameter is R, the rotation acceleration set beforehand as the rotation acceleration in a state the printing medium 90 is not yet wound around the paper core rotatably supported by the winding mechanism 40 is Ar, and the reference winding diameter is Rr, A is "Ar×(Rr/R)".

Therefore, the transport controller 17*a* controls the rotation speed and the rotation acceleration of the motor 44 so that the rotation speed of the motor 44 is accelerated up to V with the rotation acceleration A, and thereafter the rotation speed of the motor 44 is maintained at V based on the detection value of the encoder 46 and the value of the clock 15.

If the winding diameter detected in S107 is not updated, the transport controller 17*a* uses the winding diameter detected in S107 as the current winding diameter R, but if the winding diameter detected in S107 is updated, the updated most recent winding diameter is used as the current winding diameter R. In the bar mode process, the transport controller 17*a* can update the winding diameter based on the rotation amount of the rotating shaft 43*a* detected by the encoder 46 and the length of the printing medium 90 transported by the transportation roller 23 between a time point at which the angle θ reaches an angle determined in advance and a time point at which the angle θ again returns to the angle determined in advance. In the winding mode process, to be described later, the transport controller 17*a* can update the winding diameter based on the rotation amount of the rotating shaft 43*a* detected by the encoder 46 and the length of the printing medium 90 transported by the transportation roller 23 between two time points at which the torque is limited by the torque limiter 45. When the motor 44 is generating the power for winding the printing medium 90 with the winding mechanism 40, the transport controller 17*a* can determine that the torque is being limited by the torque limiter 45 if the rotation amount of the rotating shaft 43*a* detected by the encoder 46 does not change.

After the process of S133, the transport controller 17*a* determines whether or not a specific time, for example, ten seconds has elapsed from the start of the operation of the winding mechanism 40 in immediately preceding S133 based on the value of the clock 15 (S134).

The reason for determining in S134 whether or not the specific time has elapsed from the start of the operation of the winding mechanism 40 in immediately preceding S133 will now be described.

Figure 11:
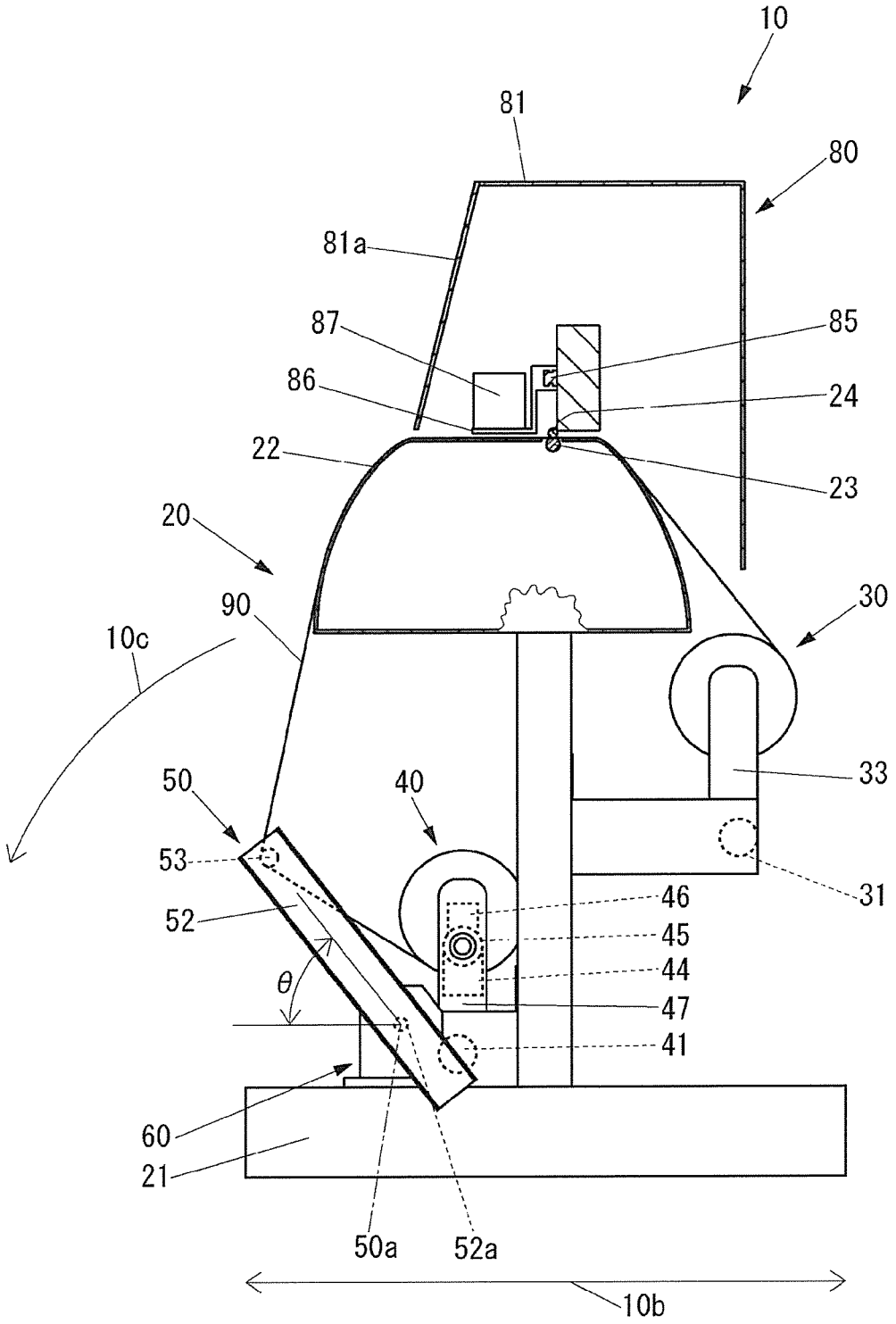
FIG. 11 is a side cross-sectional view of the inkjet printer shown in FIG. 1 when the angle of the tension applying member having the specific axis line as the center is smaller than a lower limit of the specific range.

FIG. 11 is a side cross-sectional view of the inkjet printer 10 when the angle θ of the tension applying member 50 having the axis line 50*a* as the center is smaller than the lower limit of the specific range.

The "specific range" and the "specific time" are set so that the angle θ falls within the specific range as shown in FIG. 3, when the printing medium 90 is wound by the winding mechanism 40 for the specific time while the angle θ is smaller than the lower limit of the specific range as shown in FIG. 11. Therefore, the process of S134 is provided to have the angle θ within the specific range when the angle θ is smaller than the lower limit of the specific range.

As shown in FIG. 10, when determining that the specific time has not elapsed in S134, the transport controller 17*a* determines whether or not the angle θ detected by the angle detection device 60 is within the specific range (S135).

When determining that the angle θ is not within the specific range in S135, the transport controller 17*a* carries out the process of S134.

When determining that the angle θ is within the specific range in S135, the transport controller 17*a* terminates the operation of the winding mechanism 40 by stopping the motor 44 (S136), and carries out the process of S131.

When determining that the specific time has elapsed in S134, the transport controller 17*a* terminates the operation of the winding mechanism 40 by stopping the motor 44 (S137), unsets the flag (S138), and terminates the bar mode process shown in FIG. 10.

As shown in FIG. 8, after the process of S108 is terminated, the transport controller 17*a* executes the winding mode process, which is the process of "winding mode" (S111).

Figure 12:
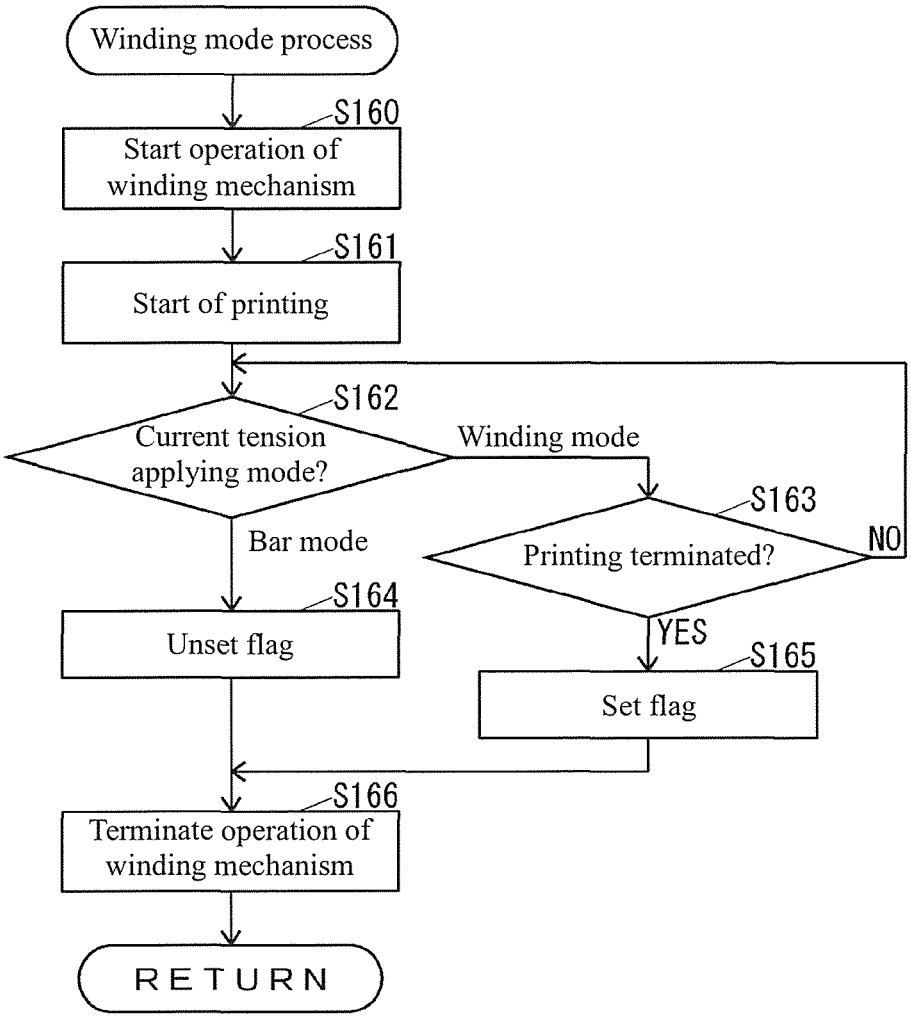
FIG. 12 is a flowchart of a winding mode process shown in FIG. 8.

FIG. 12 is a flowchart of a winding mode process shown in FIG. 8.

As shown in FIG. 12, the transport controller 17*a* starts the operation of the winding mechanism 40 by causing the motor 44 to generate the power for winding the printing medium 90 with the winding mechanism 40 (S160).

The transport controller 17*a* controls the rotation speed and the rotation acceleration of the motor 44 according to the winding diameter, as described above, to have the winding speed and the winding acceleration constant irrespective of the winding diameter.

The control unit 17 starts the printing after the process of S160 (S161). After the process of S161, the transport controller 17*a* determines the current tension applying mode (S162).

When determining that the current tension applying mode is the "winding mode" in S162, the transport controller 17*a* determines whether or not the printing is terminated (S163).

When determining that the printing is not terminated in S163, the transport controller 17*a* executes the process of S162.

When determining that the current tension applying mode is the "bar mode" in S162, the transport controller 17*a* unsets the flag (S164).

When determining that the printing is terminated in S163, the transport controller 17*a* sets the flag (S165).

After executing the process of S164 or S165, the transport controller 17*a* terminates the operation of the winding mechanism 40 by stopping the motor 44 (S166), and terminates the winding mode process shown in FIG. 12.

As shown in FIG. 8, after terminating the execution of the bar mode process in S109, the transport controller 17*a* determines whether or not the flag is set (S110).

When determining that the flag is unset in S110, the transport controller 17*a* executes the winding mode process (S111).

After terminating the execution of the winding mode process in S111, the transport controller 17*a* determines whether or not the flag is set (S112).

When determining that the flag is unset in S112, the transport controller 17*a* carries out the process of S103.

When determining that the flag is set in S110 or S112, the transport controller 17*a* terminates the operation shown in FIG. 8.

In the bar mode process shown in FIG. 10, the transport controller 17*a* controls the winding mechanism 40 so that the angle θ is maintained within the specific range (S131 to S135 and S 137). In other words, the transport controller 17*a* remains to have the winding by the winding mechanism 40 stopped when the angle θ is within the specific range (YES in S132), and executes the winding by the winding mechanism 40 when the angle θ is not within the specific range (NO in S132) (S133). Therefore, when the angle θ is within the specific range, the length of the printing medium 90 from the transportation roller 23 to the winding mechanism 40 becomes long by the length by which the printing medium 90 is transported by the transportation roller 23 while the tension is being applied by the tension applying member 50. As a result, the angle θ gradually becomes small, thus becoming smaller than the lower limit of the specific range and running out of the specific range. When the angle θ is not within the specific range, the length of the printing medium 90 from the transportation roller 23 to the winding mechanism 40 becomes short by the length by which the printing medium 90 is wound by the winding mechanism 40 while the tension is being applied by the tension applying member 50 as the printing medium 90 is wound by the winding mechanism 40. As a result, the angle θ gradually becomes large, and falls within the specific range. Thus, the printing medium 90 is wound by the winding mechanism 40 while the tension is being applied by the tension applying member 50.

Figure 13:
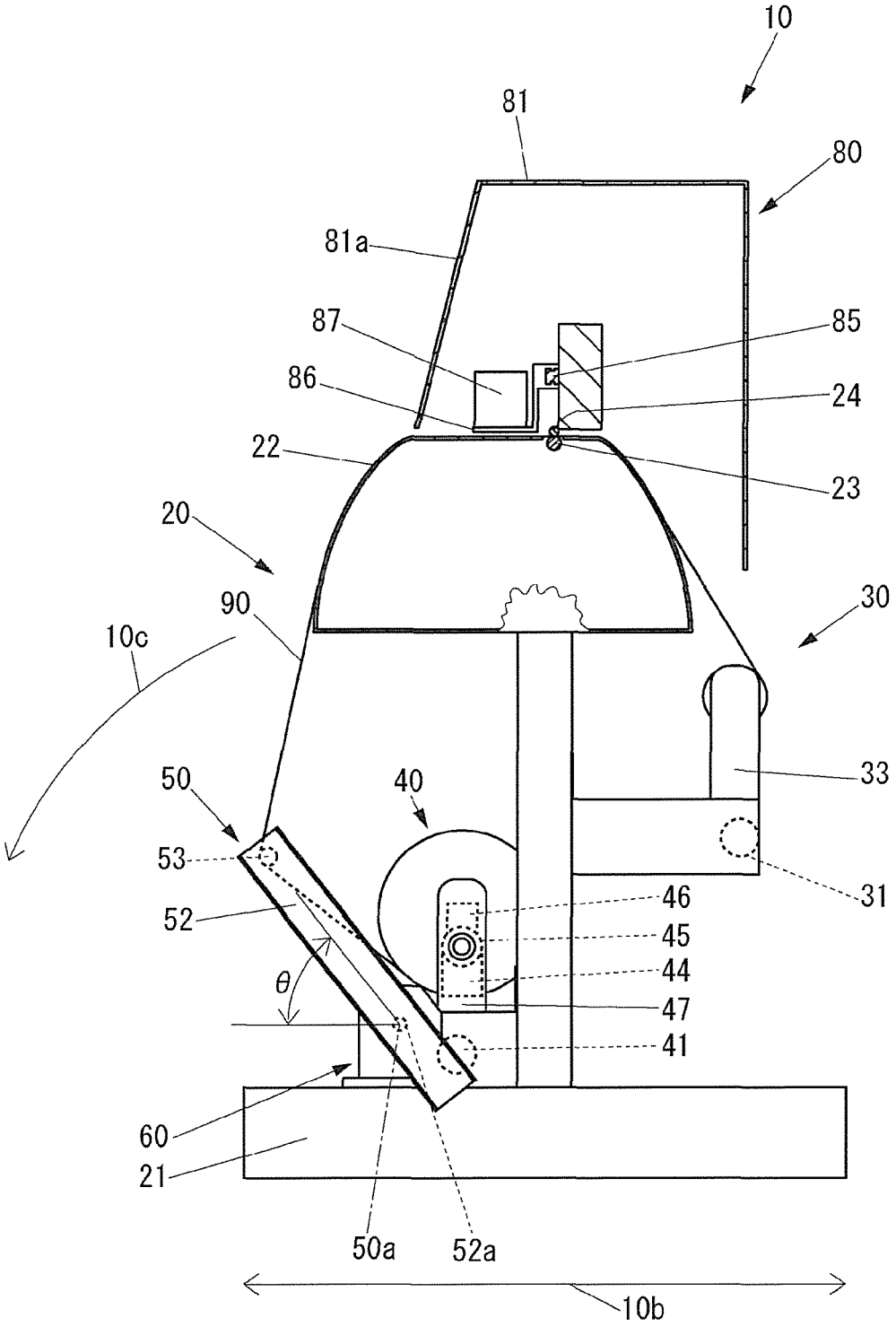
FIG. 13 is a side cross-sectional view of the inkjet printer shown in FIG. 1 when the angle of the tension applying member having the specific axis line as the center is smaller than the lower limit of the specific range in a state the winding diameter is large.

For example, when the winding diameter becomes large as shown in FIG. 13, the distance from the rotating shaft to the outer circumference of the roll-shaped printing medium 90 becomes long, and hence, even if the weight of the roll-shaped printing medium 90 is supposedly constant, the force of winding the printing medium 90 with the winding mechanism 40 becomes weak when the torque generated at the roll-shaped printing medium 90 with the winding mechanism 40 is constant. Thus, when the winding diameter becomes large, the force of winding the printing medium 90 with the winding mechanism 40 may become weak and the angle θ may not become large even if the winding mechanism 40 is controlled to wind the printing medium 90. Actually, when the winding diameter becomes large, the weight of the roll-shaped printing medium 90 becomes heavy, and hence the possibility that the angle θ will not become large further increases even if the winding mechanism 40 is controlled to wind the printing medium 90. When the specific time has elapsed (YES in S134) without the angle θ within the specific range, the transport controller 17*a* controls the winding mechanism 40 to cause the winding mechanism 40 to wind the printing medium 90 by the winding mode process shown in FIG. 12 (S160). Therefore, the printing medium 90 is wound by the winding mechanism 40 by the amount by which the printing medium 90 is transported by the transportation roller 23 while the tension is being applied by the winding mechanism 40 where the torque is limited by the torque limiter 45.

Furthermore, even when the angle θ becomes larger than the upper limit of the specific range and is no longer within the specific range, for example, when the user of the inkjet printer 10 manually moves the tension applying member 50 to change the position of the tension applying member 50 to the evacuating position shown in FIG. 6 during the execution of the bar mode process shown in FIG. 10, the transport controller 17*a* controls the winding mechanism 40 to cause the winding mechanism 40 to wind the printing medium 90 by the winding mode process shown FIG. 12 when the specific time has elapsed (YES in S134) without the angle θ within the specific range (S160). Therefore, the printing medium 90 is wound by the winding mechanism 40 by the amount by which the printing medium 90 is transported by the transportation roller 23 while the tension is being applied by the winding mechanism 40 where the torque is limited by the torque limiter 45.

The user can shift to the winding mode process by specifying the "winding mode" through the operation section 82 ("winding mode" in S139) when the bar mode process is being executed while the printing (printing operation) is stopped. Similarly, the user can shift to the bar mode process by specifying the "bar mode" through the operation section 82 ("bar mode" in S162) when the winding mode process is being executed.

However, as the specific time elapses (YES in S134) without the angle θ within the specific range if the winding diameter is large, as shown in FIG. 13, when shifted from the winding mode process to the bar mode process, the process returns from the bar mode process to the winding process, as described above. Therefore, if the winding diameter is large when shifting from the winding mode process to the bar mode process, for example, the user preferably removes a weight (not shown) attached to the tension applying member 50 to manually lighten the tension applying member 50 or adjusts the upper limit of the torque limited by the torque limiter 45 to be stronger by hand.

Furthermore, as the specific time elapses (YES in S134) without the angle θ within the specific range if the tension applying member 50 is located at the evacuating position, as shown in FIG. 6, when shifted from the winding mode process to the bar mode process, the process returns from the bar mode process returns to the winding mode process, as described above. Therefore, if the tension applying member 50 is located at the evacuating position when shifting from the winding mode process to the bar mode process, the user preferably manually moves the tension applying member 50 to a position at which the tension applying member 50 makes contact with the printing medium 90 as shown in FIG. 9.

As described above, the inkjet printer 10 can apply the tension on the printing medium 90 with the winding mechanism 40 by causing the motor 44 to generate the power for winding the printing medium 90 with the winding mechanism 40 (S160) and causing the torque limiter 45 to limit the torque, so that even if the tension cannot be applied on the printing medium 90 by the tension applying member 50 (YES in S134), the tension can be continuously applied on the printing medium 90 for a longer time than in the conventional technique by applying the tension on the printing medium 90 with the winding mechanism 40. Therefore, the inkjet printer 10 can continue the printing for a longer time than in the conventional technique by executing the printing on the printing medium 90 on which the tension is continuously applied for a longer time than in the conventional technique.

The magnitude of the tension applied on the printing medium 90 does not depend on the winding diameter when the tension is applied by the tension applying member 50, but becomes smaller the larger the winding diameter when the tension is applied by the winding mechanism 40 since the torque is limited to a constant magnitude by the torque limiter 45. In other words, the magnitude of the tension applied on the printing medium 90 by the winding mechanism 40 fluctuates in accordance with the winding diameter. In particular, if the length of the printing medium 90 is long, the fluctuation extent in the winding diameter caused by the winding of the printing medium 90 by the winding mechanism 40 is large, and hence the fluctuation extent in the magnitude of the tension applied on the printing medium 90 by the winding mechanism 40 is large. Therefore, the magnitude of the tension applied on the printing medium 90 is more stable when the tension is applied by the tension applying member 50 than when applied by the winding mechanism 40.

When the tension is being applied on the printing medium 90 by the winding mechanism 40, the printing medium 90 between the transportation roller 23 and the winding mechanism 40 slackens between when the printing medium 90 is transported by the transportation roller 23 and when the printing medium 90 is wound by the winding mechanism 40 by the amount transported by the transportation roller 23, whereby the tension applied on the printing medium 90 temporarily lowers. In other words, when the tension is being applied on the printing medium 90 by the winding mechanism 40, the tension applied on the printing medium 90 fluctuates when the printing medium 90 is wound by the winding mechanism 40. On the contrary, when the tension is being applied on the printing medium 90 by the tension applying member 50, the tension of a constant magnitude is applied on a constant basis on the printing medium 90 by the tension applying member 50 when the printing medium 90 is wound by the winding mechanism 40. In other words, the tension applied on the printing medium 90 is more stable when the printing medium 90 is wound by the winding mechanism 40 if the tension is applied on the printing medium 90 by the tension applying member 50 than if the tension is applied on the printing medium 90 by the winding mechanism 40. Therefore, the printing medium 90 is wound into a roll in a more aligned state by the winding mechanism 40 when the tension is applied on the printing medium 90 by the tension applying member 50 than when the tension is applied on the printing medium 90 by the winding mechanism 40.

As described above, the application by the tension applying member 50 is more preferable than the application by the winding mechanism 40 for the method for applying the tension on the printing medium 90.

When executing the bar mode process, the inkjet printer 10 causes the motor 44 to stop the generation of the power for winding the printing medium 90 with the winding mechanism 40 when the angle θ is within the specific range (YES in S132), so that the load of the motor 44 can be suppressed. On the other hand, when the angle θ is outside the specific range (NO in S132), the inkjet printer 10 can recover the state of applying the tension on the printing medium 90 by the tension applying member 50 by returning the angle θ to within the specific range. Therefore, the inkjet printer 10 can suppress the accumulation load of the motor 44 and extend the lifespan of the motor 44.

The inkjet printer 10 can return the angle θ to within the specific range even if the angle θ runs out of the specific range as a result of the change in the length of the printing medium 90 from the transportation roller 23 to the unwinding mechanism 30 or the winding mechanism 40 according to the transportation amount of the printing medium 90 by the transportation roller 23 while the tension is being applied on the printing medium 90 by the tension applying member 50. Therefore, the inkjet printer 10 can maintain the state of applying the tension on the printing medium 90 by the tension applying member 50 without being influenced by the transportation amount of the printing medium 90 by the transportation roller 23.

The inkjet printer 10 increases the rotation speed and the rotation acceleration of the motor 44 when the winding diameter is small, and reduces the rotation speed and the rotation acceleration of the motor 44 when the winding diameter is large to have the winding speed and the winding acceleration constant irrespective of the winding diameter. Therefore, the inkjet printer 10 can wind the printing medium 90 transported by the transportation roller 23 with the winding mechanism 40 at a constant winding speed and winding acceleration irrespective of the winding diameter when executing the winding mode process.

When referring to a large winding diameter, this means that the weight (hereinafter referred to as "wound weight") of the roll-shaped printing medium 90 wound around the paper core rotatably supported by the winding mechanism 40 is heavy. The torque of the motor 44 needs to be greater as the wound weight becomes heavier. The inkjet printer 10 controls the rotation speed and the rotation acceleration of the motor 44 in accordance with the winding diameter in the present embodiment, but may control the rotation speed and the rotation acceleration of the motor 44 in accordance with the wound weight. The wound weight is proportional to a surface area of when the roll-shaped printing medium 90 wound around the paper core rotatably supported by the winding mechanism 40 is cut along a plane orthogonal to the rotation axis of the printing medium. In other words, the wound weight is proportional to the square of the winding diameter. Therefore, the rotation speed V and the rotation acceleration A of the motor 44 controlled by the transport controller 17*a* may be "$Vr\times(Rr^2/R^2)$", "$Ar\times(Rr^2/R^2)$", respectively. When the rotation speed and the rotation acceleration of the motor 44 are controlled in accordance with the wound weight, the winding speed and the winding acceleration differ depending on the winding diameter. Therefore, when the rotation speed and the rotation acceleration of the motor 44 are controlled in accordance with the wound weight, the specific time in S134 needs to be changed according to the winding diameter so that the winding amount of the printing medium 90 by the winding mechanism 40 becomes constant irrespective of the winding diameter.

The inkjet printer 10 controls the rotation speed and the rotation acceleration of the motor 44 in accordance with the winding diameter in the present embodiment, but the rotation speed and the rotation acceleration of the motor 44 may always be constant. When the rotation speed and the rotation acceleration of the motor 44 are always constant, the time which it takes for the winding amount of the printing medium 90 by the winding mechanism 40 to reach a specific amount becomes shorter the larger the winding diameter. In other words, when the rotation speed and the rotation acceleration of the motor 44 are always constant, the specific time in S134 may be shorter the larger the winding diameter. Therefore, when the rotation speed and the rotation acceleration of the motor 44 are always constant, the inkjet printer 10 can stop the motor 44 for a longer time the larger the winding diameter, so that the lifespan of the motor 44 can be extended.

The configuration of the angle detection device 60 may be a configuration other than the configuration shown in FIG. 5 as long as the angle θcan be detected. For example, the angle detection device 60 may have a configuration shown in FIG. 14A and FIG. 14B or a configuration shown in FIG. 15A and FIG. 15B.

Figure 14A:
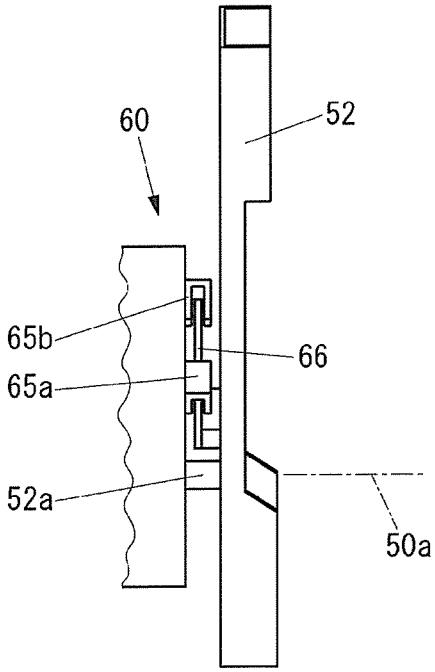
FIG. 14A is a front view of an angle detection device in an example different from the example shown in FIG. 5
Figure 14B:
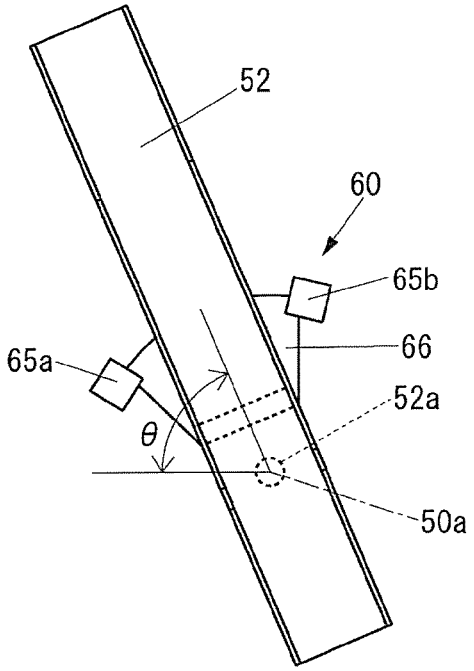
FIG. 14B is a side view of the angle detection device shown in FIG. 14A.

FIG. 14A is a front view of an angle detection device 60 in an example different from the example shown in FIG. 5. FIG. 14B is a side view of the angle detection device 60 shown in FIG. 14A.

The angle detection device 60 shown in FIG. 14A and FIG. 14B includes a photo-interrupter 65*a* fixed with respect to the leg 21 (see FIG. 3) to detect the lower limit of the specific range, a photo-interrupter 65*b* fixed with respect to the leg 21 to detect the upper limit of the specific range, and a shielding plate 66 fixed to the arm 52 and detected by the photo-interrupter 65*a* and the photo-interrupter 65*b*.

Figure 15A:
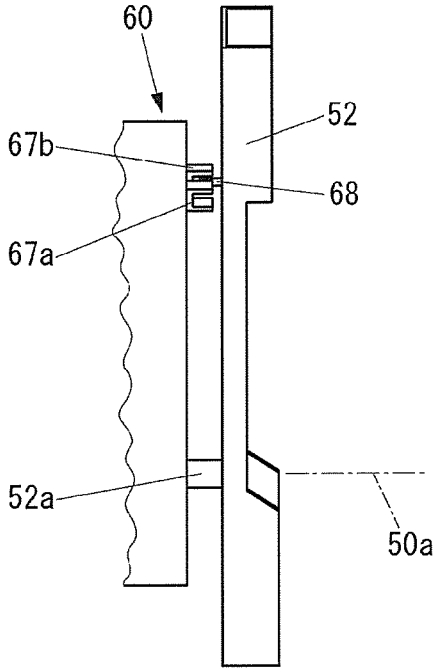
FIG. 15A is a front view of an angle detection device different from the examples shown in FIGS. 5 and 14.
Figure 15B:
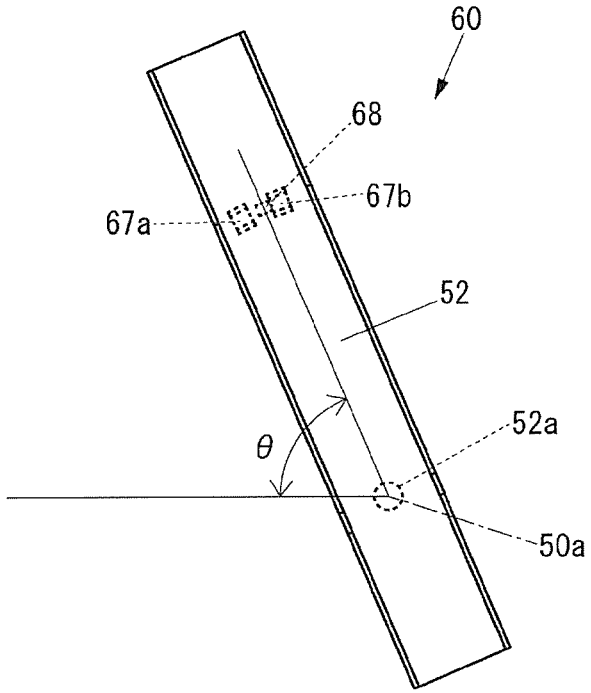
FIG. 15B is a side view of the angle detection device shown in FIG. 15A.

FIG. 15A is a front view of an angle detection device 60 in an example different from the examples shown in FIGS. 5 and 14. FIG. 15B is a side view of the angle detection device 60 shown in FIG. 15A.

The angle detection device 60 shown in FIG. 15A and FIG. 15B includes a photo-interrupter 67*a* fixed with respect to the leg 21 (see FIG. 3) to detect the lower limit of the specific range, a photo-interrupter 67*b* fixed with respect to the leg 21 to detect the upper limit of the specific range, and a shielding plate 68 fixed to the arm 52 and detected by the photo-interrupter 67*a* and the photo-interrupter 67*b*.

Figure 16:
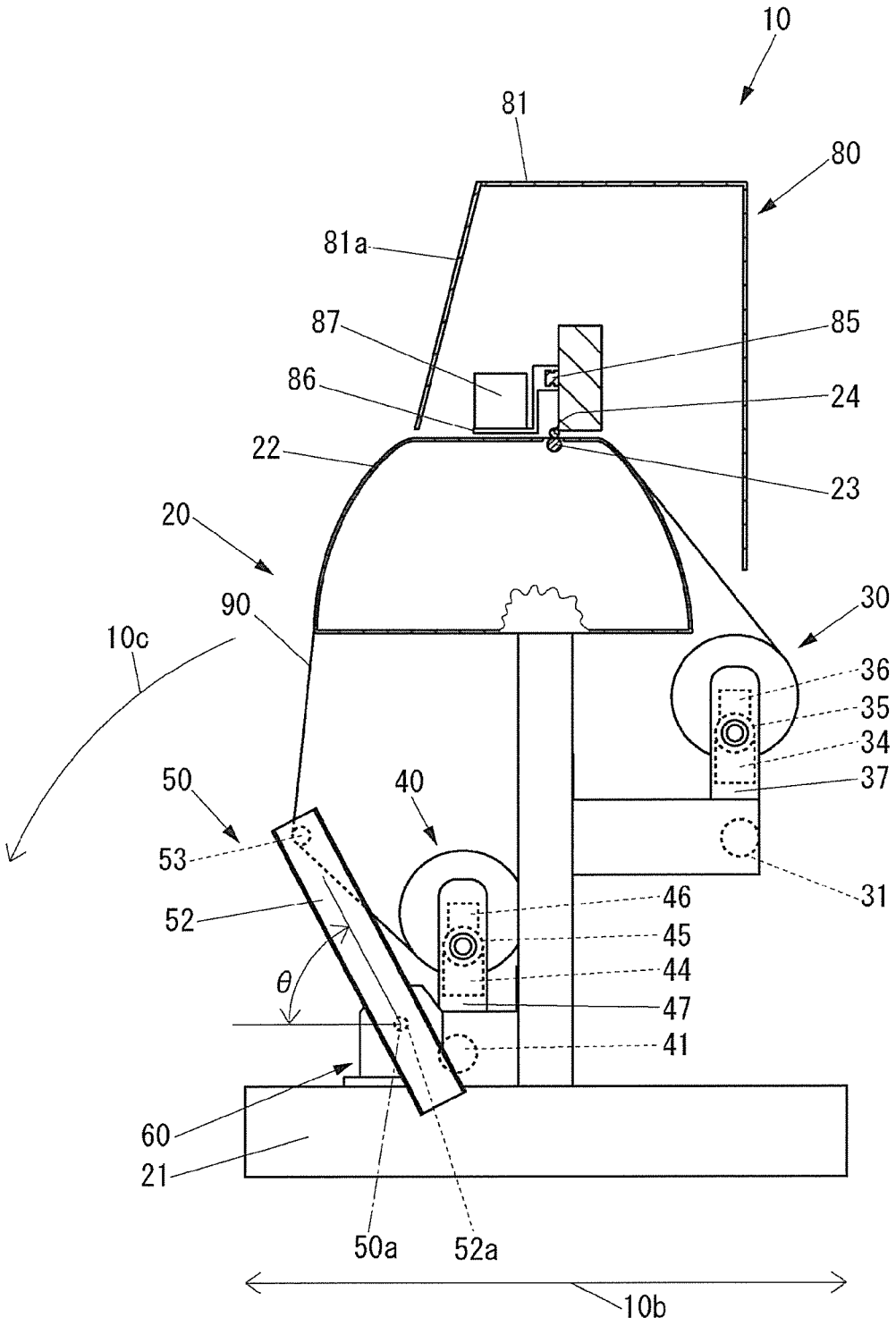
FIG. 16 is a side cross-sectional view of the inkjet printer shown in FIG. 1 in an example different from the example shown in FIG. 3.

The inkjet printer 10 does not include the motor in the unwinding mechanism 30 as shown in FIG. 3 in the present embodiment, but may include the motor 34 in the unwinding mechanism 30 as shown in FIG. 16.

FIG. 16 is a side cross-sectional view of an inkjet printer 10 in an example different from the example shown in FIG. 3.

The unwinding mechanism 30 shown in FIG. 16 has the same configuration as the configuration of the winding mechanism 40. In other words, the unwinding mechanism 30 shown in FIG. 16 includes a motor 34 that generates a driving force for rotating a rotating shaft 33*a* (see FIG. 2) of the roll holder 33 (see FIG. 2), that is, a power for rotating the printing medium 90 wound into a roll around the paper core rotatably supported by the roll holder 33; a torque limiter 35 serving as a torque limiting mechanism configuring a part of a transmission mechanism of the driving force from the motor 34 to the rotating shaft 33*a* and shielding the connection when an excessive load is applied; an encoder 36 that detects the rotation of the rotating shaft 33*a*; and a cover 37 that covers the motor 34, the torque limiter 35, and the encoder 36.

The torque limiter 35 limits the torque generated between the motor 34 side and the printing medium 90 side with a specific magnitude as an upper limit. The torque limiter 35 can allow the upper limit of the torque generated between the motor 34 side and the printing medium 90 side to be adjusted.

The unwinding mechanism 30 shown in FIG. 16 can apply tension on the printing medium 90 as the torque is limited by the torque limiter 35 when the power for winding the printing medium 90 is generated in the motor 34 by the transport controller 17*a*.

In a case of a configuration in which the sandwiching force of the printing medium 90 by the transportation roller 23 and the pinch roller 24 is weak, the inkjet printer 10 shown in FIG. 16 can apply tension on the printing medium 90 by the cooperative operation of the unwinding mechanism 30 and the winding mechanism 40 by causing the motor 34 to generate the power for winding the printing medium 90 with the unwinding mechanism 30 when causing the motor 44 to generate the power for winding the printing medium 90 with the winding mechanism 40.

If the unwinding mechanism 30 includes the motor 34 and the torque limiter 35, the inkjet printer 10 may not include the torque limiter 45 in the winding mechanism 40.

In the present embodiment, the tension applying member of the present invention can apply tension on the printing medium 90 by pushing a portion of the printing medium 90 that is not wound by the winding mechanism 40 by its own weight in the rotating direction indicated with the arrow 10*c* having the axis line 50*a* as the center. However, the tension applying member of the present invention may have other configurations. For example, the tension applying member of the present invention may have a configuration shown in FIG. 17.

Figure 17:
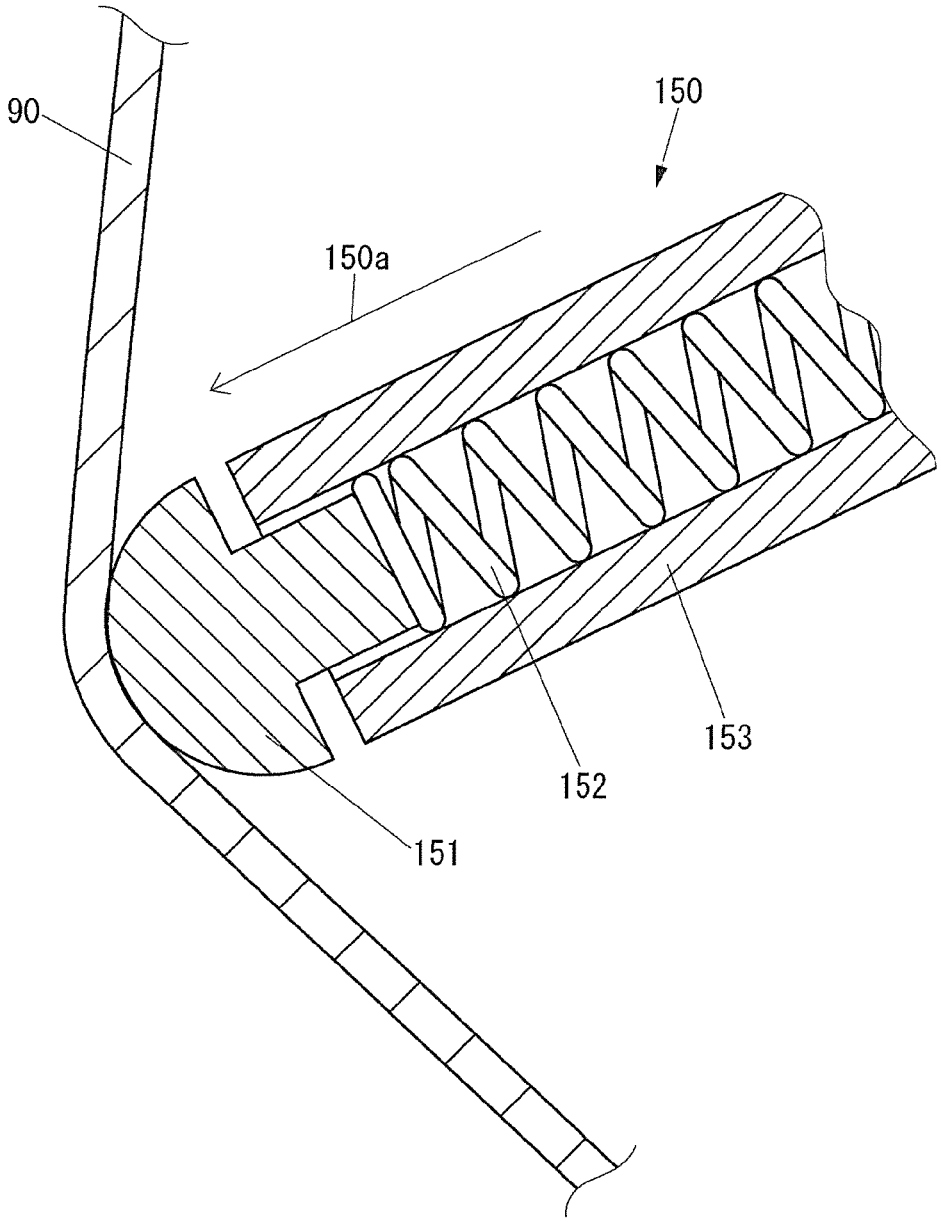
FIG. 17 is a side cross-sectional view of a tension applying member different from the tension applying member shown in FIG. 1.

FIG. 17 is a side cross-sectional view of a tension applying member 150 different from the tension applying member 50 shown in FIG. 1.

As shown in FIG. 17, the tension applying member 150 includes a contacting portion 151 that makes contact with the portion of the printing medium 90 that is not wound by the winding mechanism 40 (see FIG. 1), a spring 152 that biases the contacting portion 151 in a direction indicated with an arrow 150*a*, and an accommodating portion 153 that accommodates the spring 152. The tension applying member 150 can apply tension on the printing medium 90 by pushing the portion of the printing medium 90 that is not wound by the winding mechanism 40 in the direction indicated with the arrow 150*a*.

In the present embodiment, the inkjet printer 10 limits the torque with the torque limiter, which is a component different from the motor. However, the method of limiting the torque may be a method other than the torque limiter. For example, the inkjet printer 10 may adopt a method of exhibiting the function of the torque limiter by stepping out the motor such as the stepping motor, the AC motor, and the like.

In the present embodiment, the inkjet printer 10 has a configuration of relatively moving the inkjet head 87 and the printing medium 90 in the sub-scanning direction by transporting the printing medium 90 in the sub scanning direction indicated with the arrow 10*b*, but other configurations may be adopted. For example, the inkjet printer 10 may have a configuration of relatively moving the inkjet head 87 and the printing medium 90 in the sub-scanning direction by moving the inkjet head 87 in the sub-scanning direction.

The invention claimed is:

1. A media transporting device comprising:

a medium winding mechanism that executes at least one of unwinding and winding a band-shaped medium which is wound into a roll, comprising an unwinding mechanism that unwinds the medium wound into a roll, and a winding mechanism that winds the medium unwound by the unwinding mechanism;

a tension applying member that applies tension on the medium by pushing a portion of the medium that is not wound by the medium winding mechanism in a specific direction; and a transport controller that controls transportation of the medium; wherein the medium winding mechanism includes a motor that generates a power for rotating the medium wound into a roll;

the medium winding mechanism limits a torque generated between the motor side and the medium side with a specific magnitude as an upper limit;

the transport controller causes the motor to generate the power for winding the medium when a predetermined tension is no longer applied on the medium by the tension applying member; and the medium winding mechanism limits the torque to the specific magnitude to apply the predetermined tension on the medium when the motor is caused to generate the power for winding the medium by the transport controller when the predetermined tension is no longer applied on the medium by the tension applying member, wherein the specific direction is a rotating direction having an axis line extending in a width direction of the medium orthogonal to a transporting direction of the medium as a center;

the tension applying member applies tension on the medium by pushing the portion of the medium that is not wound by the medium winding mechanism by its own weight in the rotating direction;

the media transporting device includes an angle detector that detects an angle of the tension applying member having the axis line as a center;

the tension applying member applies tension on the medium when an angle detected by the angle detector is within at least a specific range;

the transport controller stops the generation of the power by the motor for winding the medium with the medium winding mechanism when the angle detected by the angle detector is within the range; and the transport controller causes the motor to generate the power for winding the medium with the medium winding mechanism when the angle detected by the angle detector is outside the range to return the angle of the tension applying member having the axis line as the center to within the range.

2. The media transporting device according to claim 1, further comprising a transportation roller that transports the portion of the medium that is not wound by the medium winding mechanism toward a side opposite to the medium winding mechanism in the transporting direction of the medium.

3. An inkjet printer comprising:

the media transporting device according to claim 2; and an inkjet head that executes printing by ink on the medium applied with tension by the media transporting device.

4. An inkjet printer comprising:

the media transporting device according to claim 1; and an inkjet head that executes printing by ink on the medium applied with tension by the media transporting device.

* * * * *